US012203209B2

(12) United States Patent
Xu et al.

(10) Patent No.: US 12,203,209 B2
(45) Date of Patent: Jan. 21, 2025

(54) FRAME ASSEMBLY OF CLOTHES TREATMENT APPARATUS AND CLOTHES TREATMENT APPARATUS

(71) Applicant: WUXI LITTLE SWAN ELECTRIC CO., LTD., Wuxi (CN)

(72) Inventors: Yugao Xu, Wuxi (CN); Jin Woo So, Wuxi (CN)

(73) Assignee: WUXI LITTLE SWAN ELECTRIC CO., LTD., Wuxi (CN)

( * ) Notice: Subject to any disclaimer, the term of this patent is extended or adjusted under 35 U.S.C. 154(b) by 742 days.

(21) Appl. No.: 17/434,755

(22) PCT Filed: Dec. 25, 2019

(86) PCT No.: PCT/CN2019/128388

§ 371 (c)(1),
(2) Date: Aug. 29, 2021

(87) PCT Pub. No.: WO2021/051703

PCT Pub. Date: Mar. 25, 2021

(65) Prior Publication Data

US 2022/0136165 A1 May 5, 2022

(30) Foreign Application Priority Data

Sep. 17, 2019 (CN) ..... 201910875832.0

(51) Int. Cl.
*D06F 58/20* (2006.01)
*D06F 29/00* (2006.01)

(52) U.S. Cl.
CPC ..... *D06F 58/20* (2013.01); *D06F 29/005* (2013.01)

(58) Field of Classification Search
CPC ..... D06F 58/20; D06F 29/005
USPC ..... 34/595–610
See application file for complete search history.

(56) References Cited

U.S. PATENT DOCUMENTS 5,546,678 A * 8/1996 Dhaemers ..... F26B 21/02 34/224
5,548,908 A * 8/1996 Torborg ..... D06F 58/06 34/601
5,651,192 A * 7/1997 Horwitz ..... D06F 58/30 236/78 D (Continued)

FOREIGN PATENT DOCUMENTS

CN 1958931 A 5/2007
CN 204385513 U 6/2015

(Continued)

OTHER PUBLICATIONS

Brazilian Patent and Trademark Office (INPI) The Search Report for BR Application No. BR112021019997-7 Jul. 19, 2023 9 Pages (Translation Included).

*Primary Examiner* — Stephen M Gravini
(74) *Attorney, Agent, or Firm* — Anova Law Group, PLLC

(57) ABSTRACT

A frame assembly of a clothes treatment apparatus and a clothes treatment apparatus are disclosed. The frame assembly includes: a support frame forming an accommodation space for accommodating a clothes treatment drum; a support structure connected to the support frame and supporting the clothes treatment drum; and a limiting structure arranged on the support frame and cooperating with the support structure to limit displacement of the support structure.

17 Claims, 13 Drawing Sheets

(56) References Cited

U.S. PATENT DOCUMENTS

| | | | | |
|---|---|---|---|---|
| 6,941,678 | B2 * | 9/2005 | Park | D06F 34/18 34/604 |
| 7,559,156 | B2 * | 7/2009 | Renzo | D06F 58/04 49/435 |
| 8,434,243 | B2 * | 5/2013 | Kim | D06F 34/34 34/606 |
| 9,488,412 | B2 * | 11/2016 | Yu | D06F 58/206 |
| 9,828,715 | B2 * | 11/2017 | Kwon | D06F 39/10 |
| 9,896,797 | B2 * | 2/2018 | Shin | D06F 58/22 |
| 10,344,424 | B2 * | 7/2019 | Kim | D06F 58/206 |
| 10,889,933 | B2 * | 1/2021 | Choi | D06F 58/06 |
| 2004/0163275 | A1 | 8/2004 | Hwang | |
| 2007/0159034 | A1 | 7/2007 | Funcken et al. | |
| 2022/0136165 | A1 * | 5/2022 | Xu | D06F 58/20 34/603 |
| 2023/0212805 | A1 * | 7/2023 | Kim | D06F 39/04 68/13 R |

FOREIGN PATENT DOCUMENTS

| | | | | | |
|---|---|---|---|---|---|
| CN | 105483977 | A | | 4/2016 | |
| CN | 206646299 | U | | 11/2017 | |
| CN | 207391862 | U | | 5/2018 | |
| CN | 207537778 | U | | 6/2018 | |
| CN | 208151724 | U | | 11/2018 | |
| CN | 110219132 | A | | 9/2019 | |
| CN | 209669524 | U | | 11/2019 | |
| CN | 209669545 | U | | 11/2019 | |
| CN | 111394930 | A | | 7/2020 | |
| CN | 110629484 | B | * | 9/2021 | D06F 39/12 |
| EP | 3940134 | A1 | * | 1/2022 | D06F 39/12 |
| KR | 20040050499 | A | * | 6/2004 | |
| KR | 20050119260 | A | | 12/2005 | |
| KR | 100732549 | B1 | | 6/2007 | |
| WO | WO-2021051703 | A1 | * | 3/2021 | D06F 39/12 |

* cited by examiner

FRAME ASSEMBLY OF CLOTHES TREATMENT APPARATUS AND CLOTHES TREATMENT APPARATUS

CROSS-REFERENCES TO RELATED APPLICATIONS

The present disclosure is a national phase application of International Application No. PCT/CN2019/128388, filed on Dec. 25, 2019, which claims priority to Chinese Patent Application Serial No. 201910875832.0, filed on Sep. 17, 2019, the entireties of which are herein incorporated herein by reference.

FIELD

This application relates to the field of clothes treatment technology and, more particularly, to a frame assembly of a clothes treatment apparatus and a clothes treatment apparatus.

BACKGROUND

In the related art, front supports for clothes dryers in clothes treatment apparatuses are usually fixed on front sealing doors, and there is no direct fixation or constraint between front supports and frames or cabinets. During operation of the clothes treatment apparatuses, the front supports may be easily deformed, causing air leakage, which will affect sealing and thus the performance of the clothes dryers.

SUMMARY

The present disclosure aims to solve at least one of the above problems in the related art. Accordingly, the present disclosure proposes a frame assembly of a clothes treatment apparatus, which has high structural strength.

The present disclosure also proposes a clothes treatment apparatus.

A frame assembly of a clothes treatment apparatus according to embodiments of the present disclosure includes: a support frame forming an accommodation space for accommodating a clothes treatment drum; a support structure connected to the support frame and supporting the clothes treatment drum; and a limiting structure arranged on the support frame and cooperating with the support structure to limit displacement of the support structure.

In the frame assembly of the clothes treatment apparatus according to the embodiments of the present disclosure, the limiting structure is provided to cooperate with the support structure to limit the displacement of the support structure, and preventing the support structure from being deformed by force during operation of the clothes treatment apparatus. Thus, problems such as air leakage or poor sealing due to deformation of the support structure can be avoided, the overall structural strength can be enhanced, and the structural stability of the frame assembly can be improved, prolonging the service life and improving use performance.

In the frame assembly according to the embodiments of the present disclosure, the limiting structure includes a positioning bracket arranged on a top of the support frame; an insertion groove is formed on one of the positioning bracket and the support structure; and an insertion part is formed on the other of the positioning bracket and the support structure, the insertion part being inserted into the insertion groove.

In some examples, the support structure is provided with a first positioning plate protruding from an outer surface of the support structure, and the first positioning plate and the support structure define the insertion groove.

In some examples, the support frame is provided with a second positioning plate protruding from the outer surface of the support structure, and the second positioning plate and the first positioning plate are connected to close a lower opening of the insertion groove.

In some examples, a reinforcement rib is arranged on an outer surface of the first positioning plate.

In some examples, at least two first positioning plates and the support structure define at least two insertion grooves, and openings of the at least two insertion grooves are arranged opposite to each other.

In some examples, the positioning bracket includes: a first connection plate fixedly connected to the support frame; and a second connection plate connected to the first connection plate, at least a portion of the second connection plate being formed into the insertion part.

In some examples, the top of the support frame has a bracket positioning hole, and the positioning bracket has a positioning protrusion protruding downward; the bracket positioning hole includes a first hole site and a second hole site in communication with each other, and a size of the first hole site is larger than a size of the second hole site; and the positioning protrusion is configured to be inserted downwards into the first hole site and slide towards the second hole site.

In some examples, the support frame includes a top transverse beam, a positioning groove and a fixing boss are arranged on a top surface of the top transverse beam, and the fixing boss is located on a side of the positioning groove; the positioning groove and the fixing boss each extend along a length direction of the top transverse beam, the bracket positioning hole is arranged on the fixing boss, and the positioning bracket has a positioning flange configured to be inserted into the positioning groove.

In some examples, the positioning bracket is fixedly connected to the support frame by a fastener.

In the frame assembly according to the embodiments of the present disclosure, the limiting structure includes a frame connector arranged in the middle of the support frame and connected to the support structure; and the frame connector has a pre-pressing boss protruding towards a side of the support structure, and the pre-pressing boss is configured to exert pre-pressure on the support structure.

In some examples, the frame connector is provided with a first connection hole, and the support structure is provided with a second connection hole; and the frame connector and the support structure are connected by a fastener passing through the first connection hole and the second connection hole, the first connection hole running through the pre-pressing boss.

In some examples, the frame connector includes: a connection body fixedly connected to the support frame; and a connection arm arranged on a side of the connection body facing the support structure. A first side of the connection arm facing away the support structure has a positioning recess, a second side of the connection arm facing the support structure has the pre-pressing boss, and a position of the pre-pressing boss corresponds to a position of the positioning recess.

In some examples, the connection body extends along a vertical direction, two connection arms are arranged at two ends of the connection body, and the connection arms are recessed toward an interior of the support frame relative to the connection body.

In some examples, frame connectors are arranged on left and right sides of the support structure.

A clothes treatment apparatus according to embodiments of the present disclosure includes the frame assembly according to the embodiments of the present disclosure.

Embodiments of the present disclosure will be given in part in the following descriptions, become apparent in part from the following descriptions, or be learned from the practice of the embodiments of the present disclosure.

BRIEF DESCRIPTION OF THE DRAWINGS

Embodiments of the present disclosure will become apparent and more readily appreciated from the following descriptions made with reference to the drawings, in which.

Figure 1:
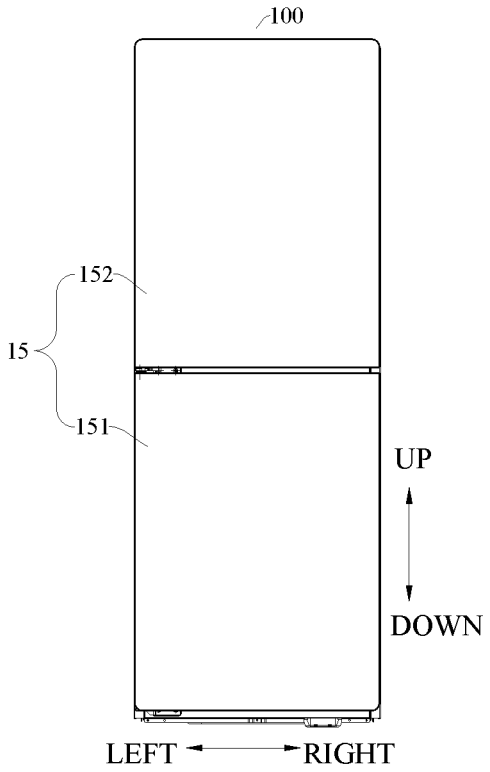
FIG. 1 is a front view of a clothes treatment apparatus according to an embodiment of the present disclosure.
Figure 2:
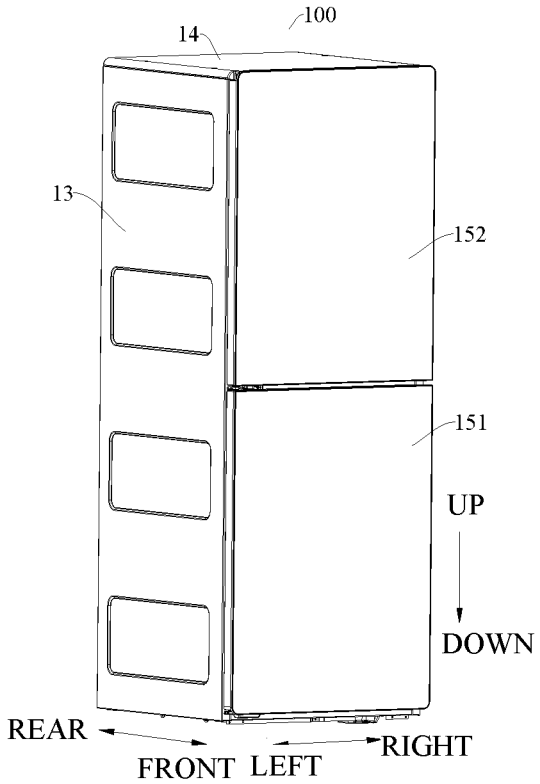
FIG. 2 is a perspective view of a clothes treatment apparatus according to an embodiment of the present disclosure.
Figure 3:
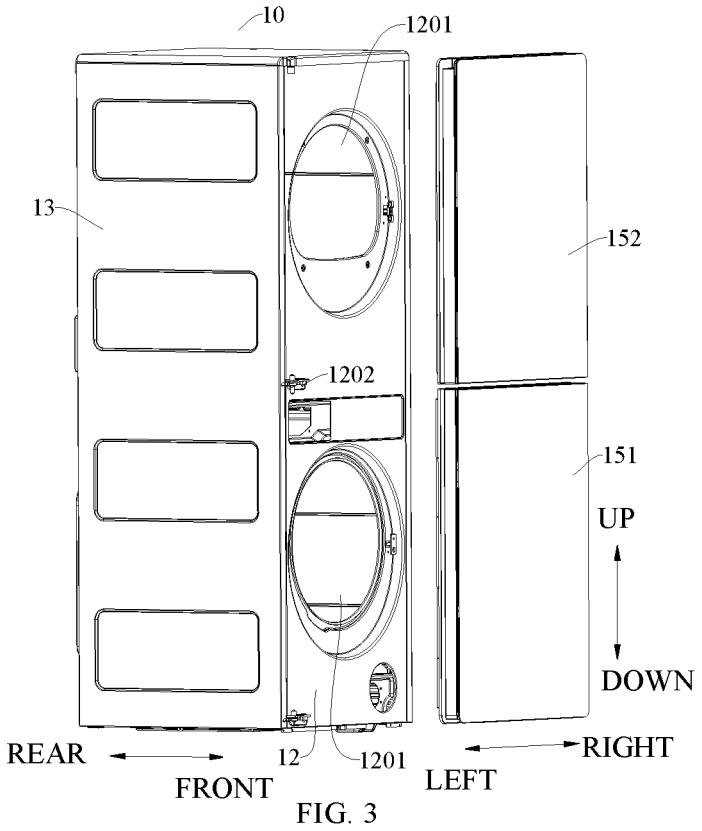
FIG. 3 is a schematic view of a structure of a cabinet of a clothes treatment apparatus according to an embodiment of the present disclosure.
Figure 4:
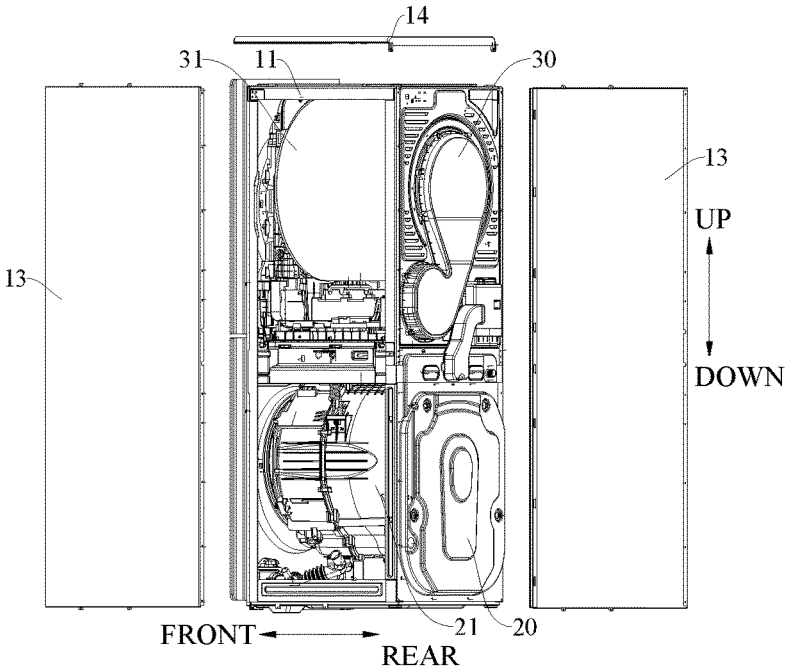
FIG. 4 is an exploded view of the structure shown in FIG. 3.

REFERENCE NUMERALS clothes treatment apparatus 100, cabinet 10, support frame 11, first accommodation space 1101, second accommodation space 1102, frame connection hole 1104, frame perforation 1105, frame positioning hole 1106, base 111, bottom plate 1111, side plate 1112, second hinge mount 1113 (1184), third vertical beam 112, fourth vertical beam 113, first accommodation recess 1131, snap hole 11311, second accommodation recess 1132, first fixing perforation 11321, second fixing perforation 11322, first connection tab 1133, notch 11331, first perforation 11332, second connection tab 1134, second perforation 11341, second vertical beam 114, second lower vertical beam 1141, second upper vertical beam 1142, vertical beam connection tab 11421, first vertical beam 115, first lower vertical beam 1151, first upper vertical beam 1152, connecting transverse beam 117, tongue 1171, first hinge mount 1172, top connection bracket 118, top transverse beam 1181, positioning groove 11811, fixing boss 11812, bracket positioning hole 11813, first hole site 118131, second hole site 118132, first connection flange 1182, insert 11821, first through hole 11822, second connection flange 1183, second through hole 11831, front panel 12, opening 1201, mounting recess 1202, panel mounting part 121, panel connection hole 1211, panel perforation 1212, panel positioning hole 1213, panel connector 122, panel connection part 1221, connection perforation 12211, connection post 1222, support leg 1221, positioning post 1223, connection protrusion 1224, recess 1225, side panel 13, panel covering part 131, snap groove 1311, top panel 14, door assembly 15, first door 151, second door 152, mounting cavity 1520, mounting opening 1521, cover plate 1522, control panel 1523, intermediate hinge 153, intermediate mounting part 1531, intermediate connection part 1532, upper fixed shaft 1533, lower fixed shaft 1534, first end hinge 154, first end-face mounting part 1541, first end-face connection part 1542, lower connection shaft 1543, second end hinge 155, second end-face mounting part 1551, second end connection part 1552, upper connection shaft 1553, first clothes treatment module 20, first clothes treatment drum 21, second clothes treatment module 30, second clothes treatment drum 31, clothes fetching port 311, support structure 312, second connection hole 3121, insertion groove 3122, first positioning plate 31221, second positioning plate 31222, reinforcement rib 31223, frame connector 313, first connection hole 3131, first fixing protrusion 3132, second fixing protrusion 3133, connection body 3134, connection arm 3135, prepressing boss 3136, positioning recess 3137, positioning bracket 314, first connection plate 3141, second connection plate 3142, insertion part 3143, positioning protrusion 3144, positioning flange 3145, chassis 32, suction zone 321, fan mounting cavity 322, heat pump mounting cavity 323, reinforcement plate 33, first plate portion 331, first ventilation hole 3311, reinforcement recess 3313, second plate portion 332, second ventilation hole 3321, reinforcement protrusion 3323, mounting boss 3324, mounting hole 3325, fixing flange 333, fixing hole 3331, insertion hole 3332, first mounting flange 334, second mounting flange 335, avoidance notch 336.

DETAILED DESCRIPTION OF THE DISCLOSURE

Embodiments of the present disclosure will be described in detail below, and examples of the embodiments will be shown in the accompanying drawings. The same or similar elements and the elements having same or similar functions are denoted by like reference numerals throughout the descriptions. The embodiments described below are exemplary and are intended to explain the present disclosure rather than limit the present disclosure.

A clothes treatment apparatus 100 according to embodiments of the present disclosure will be described below with reference to FIGS. 1-43.

As shown in FIGS. 27-32, a frame assembly of the clothes treatment apparatus 100 according to an embodiment of the present disclosure includes: a support frame 11, a support structure 312, and a limiting structure.

The support frame 11 forms an accommodation space for accommodating a clothes treatment drum. The support structure 312 is connected to the support frame 11 and used to support the clothes treatment drum. The limiting structure is arranged on the support frame 11 and cooperates with the support structure 312 to limit displacement of the support structure 312.

In the frame assembly of the clothes treatment apparatus 100 according to the embodiment of the present disclosure, the limiting structure is provided to cooperate with the support structure 312 to limit the displacement of the support structure 312, and preventing the support structure 312 from being deformed by force during operation of the clothes treatment apparatus 100. Thus, problems such as air leakage or poor sealing due to deformation of the support structure 312 can be avoided, the overall structural strength can be enhanced, and the structural stability of the frame assembly can be improved, prolonging the service life and improving use performance.

In some examples, during the operation of the clothes treatment apparatus 100, the support structure 312 is mounted in cooperation with the clothes treatment drum and functions to support the clothes treatment drum; the limiting structure cooperates with the support structure 312, and can limit displacement of the support structure 312 in an axial direction of the clothes treatment drum (i.e., a front-rear direction shown in FIG. 27) or limit displacement of the support structure 312 in a radial direction of the clothes treatment drum (i.e., a left-right direction shown in FIG. 27) to improve the overall structural stability and the operational reliability.

Figure 31:
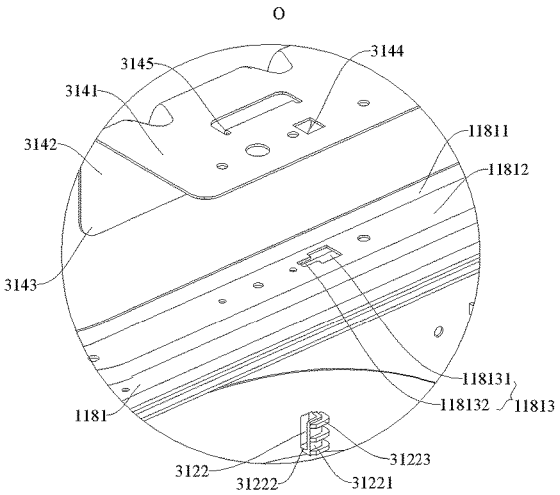
FIG. 31 is an enlarged view of part O shown in FIG. 29.

As shown in FIG. 31, according to an embodiment of the present disclosure, the limiting structure includes a positioning bracket 314 arranged on a top of the support frame 11. An insertion groove 3122 is formed in the positioning bracket 314, and the support structure 312 is formed with an insertion part 3143 configured to be inserted into the insertion groove 3122, so that the positioning bracket 314 and the support structure 312 can cooperate with each other through insertion, in which the connection is convenient. After the connection, displacement of the support structure 312 in a direction perpendicular to the insertion part 3143 can be limited under the action of the positioning bracket 314. Hence, making an extension direction of the insertion part 3143 perpendicular to the axial direction of the clothes treatment drum can limit the displacement of the support structure 312 in the axial direction of the clothes treatment drum. In one embodiment, the insertion groove 3122 may also be formed in the support structure 312 and the insertion part 3143 formed on the positioning bracket 314.

As shown in FIG. 31, in some examples, the support structure 312 is provided with a first positioning plate 31221 protruding from an outer surface of the support structure 312, and the insertion groove 3122 is formed between the first positioning plate 31221 and the support structure 312. By arranging the first positioning plate 31221 on the outer surface of the support structure 312, the insertion part 3143 on the positioning bracket 314 can be inserted and connected to the outer surface of the support structure 312 to achieve fit between the two, with little modification to the support structure 312 and with easy manufacture and assembly.

As shown in FIG. 31, in some examples, the support frame 11 is also provided with a second positioning plate 31222 protruding from the outer surface of the support structure 312. The second positioning plate 31222 is connected to the first positioning plate 31221, and closing a lower opening of the insertion groove 3122. During insertion of the insertion part 3143, the insertion part 3143 can stop against a bottom of the insertion groove 3122, allowing the insertion groove 3122 to support the insertion part 3143 to a certain extent, and improving the structural stability.

Meanwhile, during assembly, once the insertion part 3143 stops against the bottom of the insertion groove 3122, information about "being mounted in place" can be obtained, and to assemble and operate and improves the assembly efficiency.

As shown in FIG. 31, in some examples, a reinforcement rib 31223 is arranged on an outer surface of the first positioning plate 31221, which can increase the structural strength of the first positioning plate 31221 and prevent the first positioning plate 31221 from being damaged and from causing failure of the fit between the insertion part 3143 and the insertion groove 3122, and avoiding deformation of the support structure 312.

In some examples, there are at least two first positioning plates 31221, and each first positioning plate 31221 and the support structure 312 form one insertion groove 3122, so that the support structure 312 is provided with at least two insertion grooves 3122. Openings of the at least two insertion grooves 3122 are arranged opposite to each other, and the two insertion grooves 3122 can be located on both sides of the insertion part 3143, and improving the stability of the fit between the insertion part 3143 and the insertion grooves 3122 and preventing the support structure 312 from being deformed by force during the operation of the clothes treatment apparatus 100.

Figure 29:
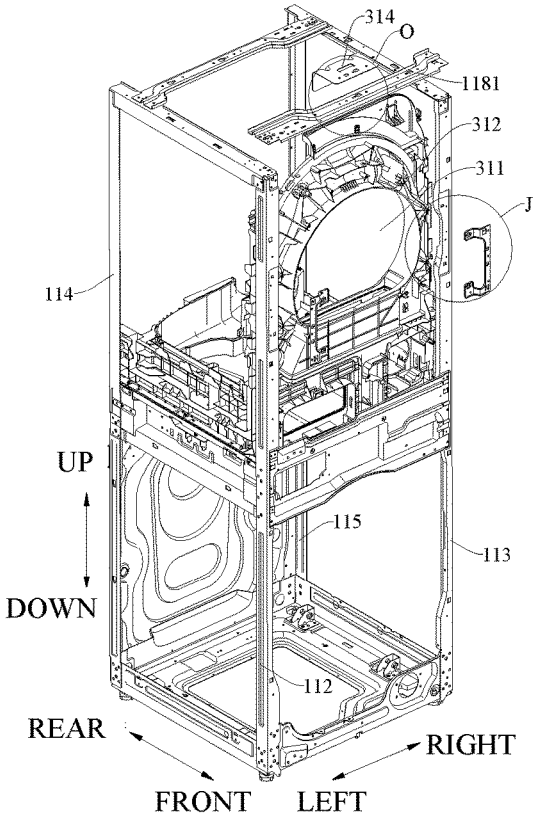
FIG. 29 is an exploded view of a support frame and a support structure of a clothes treatment apparatus according to an embodiment of the present disclosure.

As shown in FIGS. 29 and 31, in some examples, the positioning bracket 314 includes a first connection plate 3141 and a second connection plate 3142. The first connection plate 3141 extends in a horizontal direction and is fixedly connected to the support frame 11. The second connection plate 3142 extends in a vertical direction, an upper side of the second connection plate 3142 is connected to the first connection plate 3141, and a lower side of the second connection plate 3142 is formed into the insertion part 3143, and enabling the lower side of the second connection plate 3142 to be directly inserted into the insertion groove 3122 in the support structure 312, which simplifies the structure, saves costs, facilitates manufacture and molding, and improves the assembly efficiency.

In some examples, the top of the support frame 11 has a bracket positioning hole 11813, and the positioning bracket 314 has a positioning protrusion 3144 protruding downward. The positioning protrusion 3144 is adapted to be inserted into the bracket positioning hole 11813, realizing the connection between the positioning bracket 314 and the support frame 11.

As shown in FIG. 31, in some examples, the bracket positioning hole 11813 includes a first hole site 118131 and a second hole site 118132 in communication with each other. A size of the first hole site 118131 is larger than a size of the second hole site 118132. The positioning protrusion 3144 is suitable to be first inserted downwards into the first hole site 118131 and then slide towards the second hole site 118132, which facilitates the connection between the positioning bracket 314 and the support frame 11 and makes the fit between the two reliable.

In some examples, the support frame 11 includes a top connection frame 118 on the top. The top connection frame 118 includes a top transverse beam 1181. A positioning groove 11811 and a fixing boss 11812 are arranged on a top surface of the top transverse beam 1181. The fixing boss 11812 is located on a side of the positioning groove 11811. The positioning groove 11811 and the fixing boss 11812 each extend along a length direction of the top transverse beam 1181. The bracket positioning hole 11813 is arranged on the fixing boss 11812. The positioning bracket 314 is provided with a positioning flange 3145 adapted to be inserted into the positioning groove 11811. The positioning flange 3145 can stop against a side wall of a side of the positioning groove 11811 close to the fixing boss 11812, so that the positioning flange 3145 wraps around the top transverse beam 1181 to improve the reliability of the fit between the positioning bracket 314 and the top transverse beam 1181 and avoid the failure of the fit between the insertion groove 3122 and the insertion part 3143 due to motion of the positioning bracket 314.

In some examples, during installation of the positioning bracket 314, the fit between the positioning flange 3145 and the positioning groove 11811 can guide the fit between the positioning protrusion 3144 and the bracket positioning hole 11813. The positioning of the positioning bracket 314 can be achieved after the positioning protrusion 3144 is fitted in the bracket positioning hole 11813. In turn, the positioning bracket 314 is fixedly connected to the top transverse beam 1181 by a fastener, so that the positioning bracket 314 can be stably connected to the top transverse beam 1181, improving the overall structural stability and reliability.

As shown in FIGS. 27-30, according to an embodiment of the present disclosure, the limiting structure includes a frame connector 313 arranged in the middle of the support frame 11 and connected to the support structure 312. The frame connector 313 has a pre-pressing boss 3136 protruding towards a side of the support structure 312. The pre-pressing boss 3136 pushes the support structure 312 backward and exerts pre-pressure on the support structure 312, so that the support structure 312 has a backward pre-deformation, which can counteract a forward pushing force exerted by clothes in the clothes treatment drum on the support structure 312 when the clothes treatment apparatus 100 is working, and avoid problems such as air leakage or poor sealing due to the deformation of the support structure 312.

Figure 30:
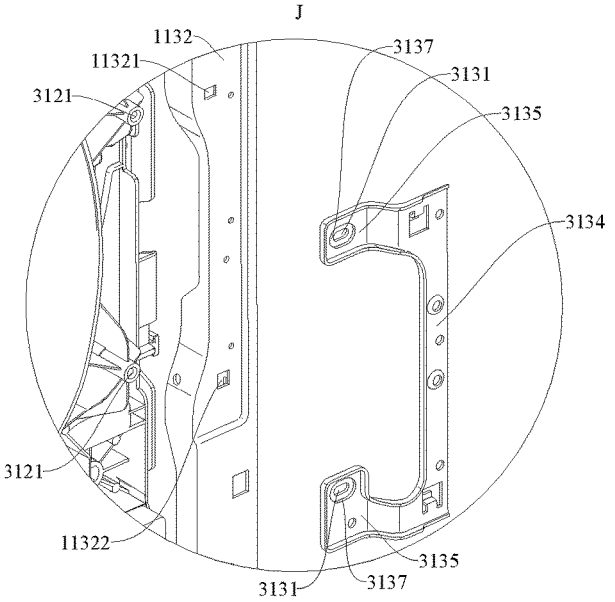
FIG. 30 is an enlarged view of part J shown in FIG. 29.

As shown in FIG. 30, in some examples, the frame connector 313 is provided with a first connection hole 3131, and the support structure 312 is provided with a second connection hole 3121. The frame connector 313 and the support structure 312 are connected by a fastener passing through the first connection hole 3131 and the second connection hole 3121. The first connection hole 3131 runs through the pre-pressing boss 3136, that is, the pre-pressing boss 3136 surrounds the first connection hole 3131. By arranging the pre-pressing boss 3136 at the fixation between the frame connector 313 and the support structure 312 to exert the pre-pressure on the support structure 312, an effect of the pre-pressing boss 3136 can be improved, avoiding deformation of the frame connector 313 at the connection of the pre-pressing boss 3136 and the support structure 312, and failure to counteract the pushing force exerted by the clothes on the support structure 312, which may affect the use performance of the limiting structure.

Figure 32:
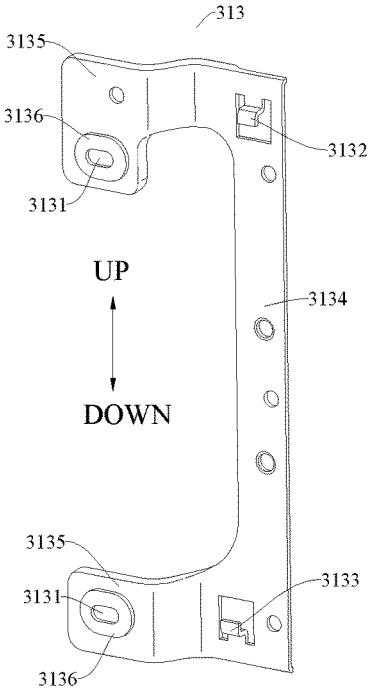
FIG. 32 is a structural schematic diagram of a frame connector of a clothes treatment apparatus according to an embodiment of the present disclosure.
Figure 33:
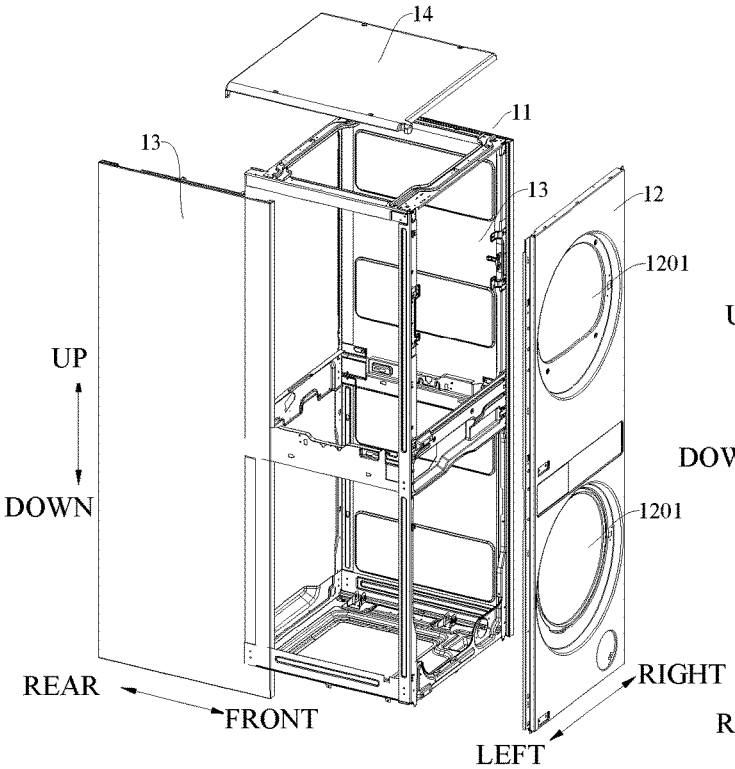
FIG. 33 is an exploded view of a support frame of a clothes treatment apparatus according to an embodiment of the present disclosure.

As shown in FIG. 30 and FIG. 32, in some examples, the frame connector 313 includes: a connection body 3134 and a connection arm 3135. The connection body 3134 is fixedly connected to the support frame 11, and the connection arm 3135 is arranged on a side of the connection body 3134 facing the support structure 312. A first side of the connection arm 3135 facing away the support structure 312 has a positioning recess 3137, a second side of the connection arm 3135 facing the support structure 312 has the pre-pressing boss 3136, and a position of the pre-pressing boss 3136 corresponds to a position of the positioning recess 3137, so that the fastener can be located in the positioning recess 3137 to prevent the fastener from protruding and affecting installation of other structural members.

In addition, the pre-pressing boss 3136 can be integrally stamped from the connection arm 3135, so that the positioning recess 3137 is formed on one side of the connection arm 3135 and the pre-pressing boss 3136 is formed on and protrudes from the other side of the connection arm 3135, resulting in simple manufacturing process and good structural stability.

As shown in FIG. 32, in some examples, the connection body 3134 extends along the vertical direction, two connection arms 3135 are arranged at two ends of the connection body 3134, and the frame connector 313 is connected to a middle portion of the support structure 312. The connection stability can be improved by the two connection arms 3135. The connection arms 3135 are recessed toward an interior of the support frame 11 relative to the connection body 3134, which facilitates the assembly of the connection arms 3135 and the support structure 312 and prevents the connection arms 3135 from protruding from the support frame 11 after being assembled with the support structure 312, which may affect aesthetics otherwise.

Figure 27:
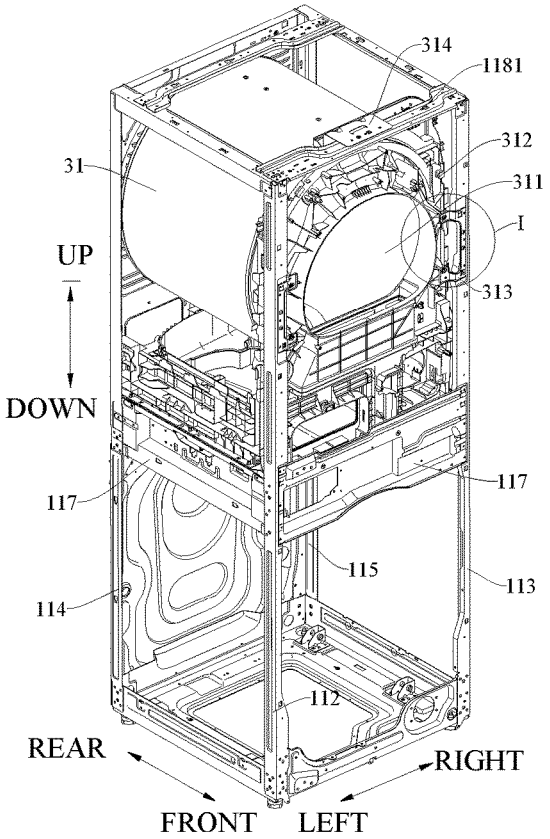
FIG. 27 is an assembly view of a support frame and a support structure of a clothes treatment apparatus according to an embodiment of the present disclosure.
Figure 28:
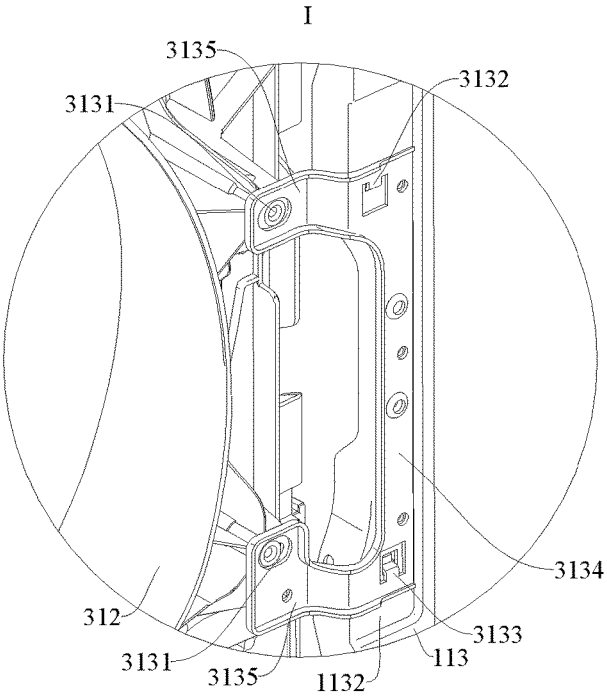
FIG. 28 is an enlarged view of part I shown in FIG. 27.

As shown in FIG. 27, in some examples, frame connectors 313 are arranged on left and right sides of the support structure 312. The left and right sides of the support structure 312 are fixedly connected to the support frame 11 by the frame connectors 313, to limit the displacement or deformation of the support structure 312 in the left-right direction; and the displacement or deformation of the support structure 312 in the front-rear direction is limited by providing pre-pressing bosses 3136.

The clothes treatment apparatus 100 according to embodiments of the present disclosure includes the frame assembly according to the present disclosure embodiment. By adopting the above frame assembly, problems such as air leakage or poor sealing due to the deformation of the support structure 312 can be avoided, and the structural strength and use performance of the clothes treatment apparatus 100 can be improved, prolonging the service life, and upgrading the use experience.

An embodiment of the clothes treatment apparatus 100 according to the present disclosure will be described in detail below in conjunction with FIGS. 1-43.

As shown in FIGS. 1-4, the clothes treatment apparatus 100 includes a cabinet 10, a door assembly 15, a first clothes treatment module 20, and a second clothes treatment module 30.

The cabinet 10 serves as a frame structure of the clothes treatment apparatus 100. The cabinet 10 includes a support frame 11. The support frame 11 includes a square base 111, connecting transverse beams 117, a top connection frame 118, and four vertical beams, namely, a first vertical beam 115, a second vertical beam 114, a third vertical beam 112 and a fourth vertical beam 113. The four vertical beams extend upward from four corners of the square base 111, respectively. The first vertical beam 115 and the second vertical beam 114 are arranged at two rear corners of the square base 111, and the third vertical beam 112 and the fourth vertical beam 113 are arranged at two front corners of the square base 111.

The square base 111 includes a bottom plate 1111 and four side plates 1112 arranged around sides of the chassis 32. Lower ends of two adjacent vertical beams are connected by the side plates 1112, middle portions of two adjacent vertical beams are connected by the connecting transverse beams 117, and an upper end of each vertical beam is connected to a corresponding one of four corners of the top connection frame 118.

The top connection frame 118, the plurality of connecting transverse beams 117, and lower portions of the four vertical beams define a first accommodation space 1101 for the assembly of the first clothes treatment module 20. The top connection frame 118, the plurality of connecting transverse beams 117, and upper portions of the four vertical beams define a second accommodation space 1102 for the assembly of the second clothes treatment module 30.

As shown in FIGS. 5 to 9, in some examples, the first vertical beam 115 includes two short vertical beams, i.e., a first lower vertical beam 1151 extending upward from the square base 111 and a first upper vertical beam 1152 extending upward from the first lower vertical beam 1151. A transverse beam of the top connection frame 118, which extends in the front-rear direction and is located on a right side of the top connection frame 118, and the first upper vertical beam 1152 are integrally made by bending a same sheet. In this embodiment, the first upper vertical beam 1152 is integrally formed with a portion of the top connection frame 118, so that the two do not need to be connected by any connection structure. A lower end of the first upper vertical beam 1152 is detachably connected to an upper end of the first lower vertical beam 1151 and is connected to the connecting transverse beam 117. The second vertical beam 114, the third vertical beam 112, and the fourth vertical beam 113 are all long vertical beams.

Before assembling the second clothes treatment module 30, the first lower vertical beam 1151, the second vertical beam 114, the third vertical beam 112, and the fourth vertical beam 113 are assembled by the square base 111 and the plurality of connecting transverse beams 117, so that respective upper portions of the second vertical beam 114, the third vertical beam 112 and the fourth vertical beam 113 define a large unobstructed mounting space, to facilitate the assembly of the second clothes treatment module 30. After the assembly is completed, the first upper vertical beam 1152 attached to the top connection frame 118 is then connected with the first lower vertical beam 1151.

Figure 10:
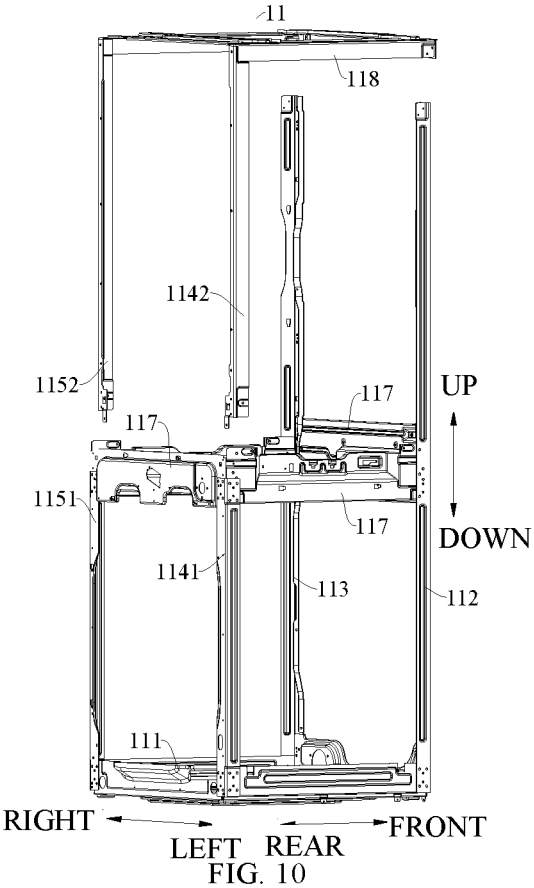
FIG. 10 is an exploded view of a support frame of a clothes treatment apparatus according to another embodiment of the present disclosure.
Figure 11:
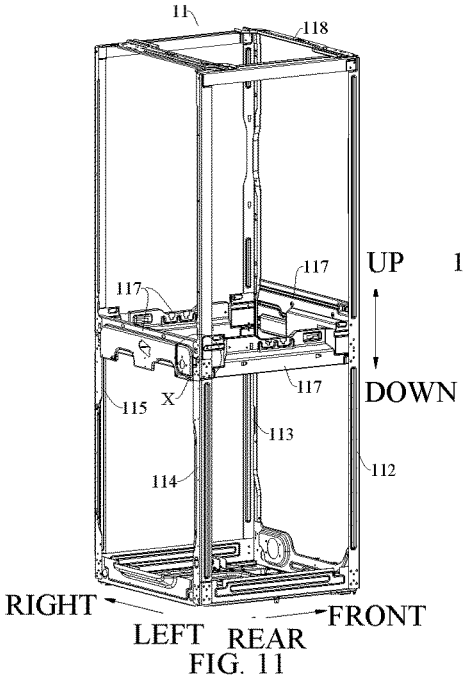
FIG. 11 is an assembly view of the support frame shown in FIG. 10.
Figure 12:
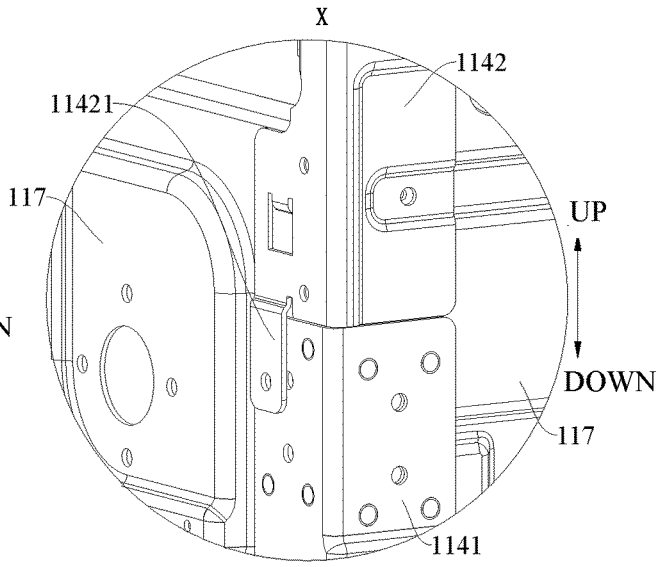
FIG. 12 is an enlarged view of X part shown in FIG. 11.

As shown in FIGS. 10 to 12, in other examples, the first vertical beam 115 and the second vertical beam 114 each include two short vertical beams. That is, the first vertical beam 115 includes a first lower vertical beam 1151 extending upward from the square base 111 and a first upper vertical beam 1152 extending upward from the first lower vertical beam 1151; the second vertical beam 114 includes a second lower vertical beam 1141 extending upward from the square base 111 and a second upper vertical beam 1142 extending upward from the second lower vertical beam 1141.

A transverse beam of the top connection frame 118, which extends in the front-rear direction and is located on a right side of the top connection frame 118, and the first upper vertical beam 1152 are integrally made by bending a same sheet; and a transverse beam of the top connection frame 118, which extends in the front-rear direction and is located on a left side of the top connection frame 118, and the second upper vertical beam 1142 are integrally made by bending a same sheet. In this embodiment, the first upper vertical beam 1152 is integrally formed with a portion of the top connection frame 118, and the second upper vertical beam 1142 is integrally formed with another portion of the top connection frame 118. The first upper vertical beam 1152 and the top connection frame 118, or the second upper vertical beam 1142 and the top connection frame 118, do not need to be connected by any connection structure. A lower end of the first upper vertical beam 1152 and an upper end of the first lower vertical beam 1151 are detachably connected and are connected to the connecting transverse beam 117. A lower end of the second upper vertical beam 1142 and an upper end of the second lower vertical beam 1141 are detachably connected and are connected to the connecting transverse beam 117. The third vertical beam 112 and the fourth vertical beam 113 are both long vertical beams.

Before assembling the second clothes treatment module 30, the first lower vertical beam 1151, the second lower vertical beam 1141, the third vertical beam 112, and the fourth vertical beam 113 are assembled by the square base 111 and the plurality of connecting transverse beams 117. Then, the second clothes treatment module 30 is assembled with the third vertical beam 112, the fourth vertical beam 113 and the connecting transverse beams 117. Finally, the first upper vertical beam 1152 and the second upper vertical beam 1142, which are attached to the top connection frame 118, are connected to the first lower vertical beam 1151 and the second lower vertical beam 1141, respectively.

Regarding the connection mode of the upper vertical beam and the lower vertical beam, the second upper vertical beam 1142 and the second lower vertical beam 1141 will be exemplified below. As shown in FIGS. 11 and 12, the lower end of the second upper vertical beam 1142 is provided with a vertical beam connection tab 11421 extending downward. The vertical beam connection tab 11421 of the second upper vertical beam 1142 is first bent outward relative to the second upper vertical beam 1142 and then extends downward, so that an outer side of the upper end of the second lower vertical beam 1141 is at least partially covered by the vertical beam connection tab 11421. The vertical beam connection tab 11421 of the second upper vertical beam 1142 is connected to the upper end of the second lower vertical beam 1141 by fasteners, and convenient and can ensure the reliability and stability of the connection between the second upper vertical beam 1142 and the second lower vertical beam 1141.

Figure 5:
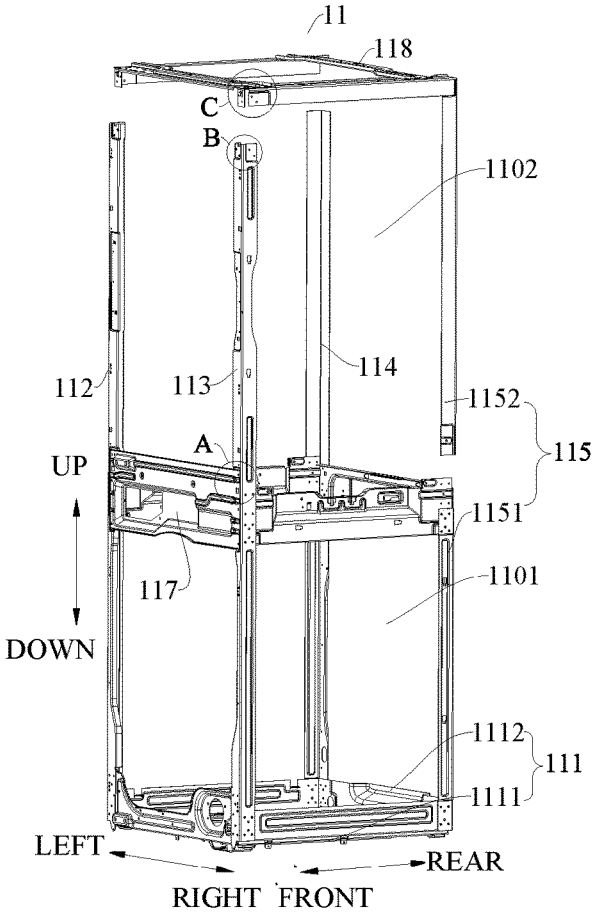
FIG. 5 is an exploded view of a support frame of a clothes treatment apparatus according to an embodiment of the present disclosure.
Figure 6:
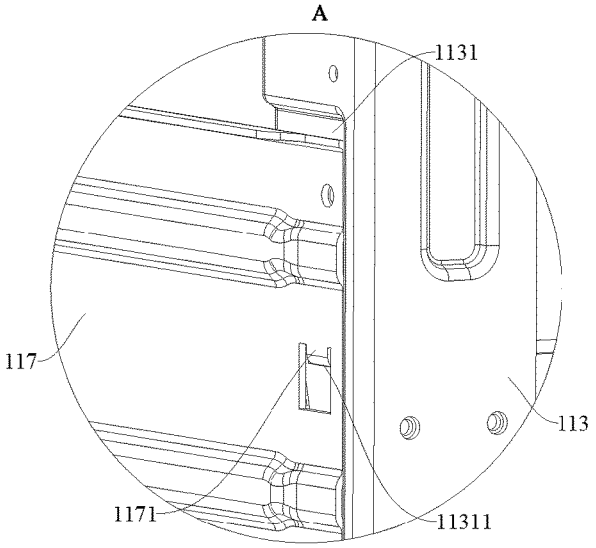
FIG. 6 is an enlarged view of part A shown in FIG. 5.

Regarding the connection mode of the vertical beams and the connecting transverse beams 117, the third vertical beam 112 and the fourth vertical beam 113 will be exemplified below. As shown in FIGS. 5 and 6, the third vertical beam 112 and the fourth vertical beam 113 each have a first accommodation recess 1131 recessed inward and located in the middle of a front side surface of the third vertical beam 112 or the fourth vertical beam 113. A bottom wall of each first accommodation recess 1131 has a snap hole 11311, and both ends of the connecting transverse beam 117 are each provided with a tongue 1171 bent downward. The two ends of the connecting transverse beam 117 are arranged in the first accommodation recesses 1131 of the third vertical beam 112 and the fourth vertical beam 113, respectively, and the tongues 1171 are inserted downward into the snap holes 11311, to mount the connecting transverse beam 117 to the third vertical beam 112 and the fourth vertical beam 113.

Figure 7:
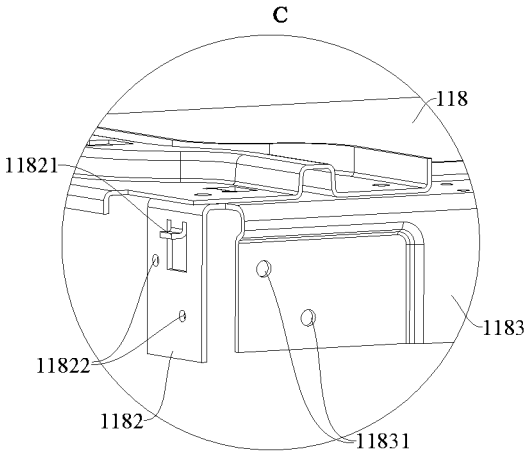
FIG. 7 is an enlarged view of part B shown in FIG. 5.
Figure 8:
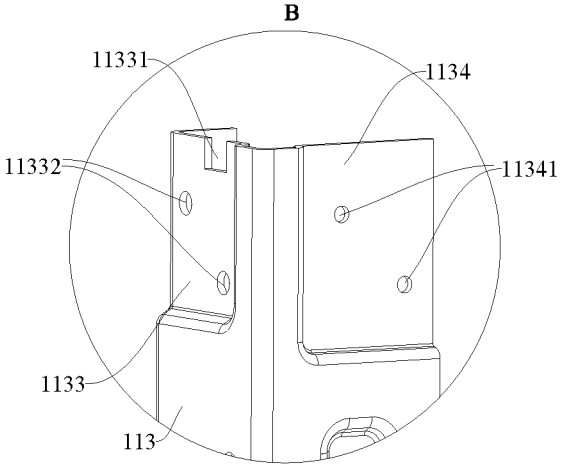
FIG. 8 is an enlarged view of part C shown in FIG. 5.

Regarding the connection mode of the vertical beams and the top connection frame 118, the fourth vertical beam 113 will be exemplified below. As shown in FIG. 5 and FIGS. 7 and 8, an upper end of the fourth vertical beam 113 has a first connection tab 1133 and a second connection tab 1134 arranged at 90 degrees. The first connection tab 1133 is provided with a notch 11331 and a first perforation 11332; and the second connection tab 1134 is provided with a second perforation 11341. A corner of the top connection frame 118 corresponding to the fourth vertical beam 113 is provided with a first connection flange 1182 and a second connection flange 1183 spaced apart from the first connection flange 1182. The first connection flange 1182 is provided with an insert 11821 bent outward and a first through-hole 11822; and the second connection flange 1183 is provided with a second through-hole 11831.

During the assembly, the first connection tab 1133 is located on an outer side of the first connection flange 1182; the second connection tab 1134 is inserted through a gap between the first connection flange 1182 and the second connection flange 1183; the insert 11821 is fitted in the notch 11331; the first connection tab 1133 and the first connection flange 1182 are connected by fasteners passing through the first perforation 11332 and the first through hole 11822, and the second connection tab 1134 and the second connection flange 1183 are connected by fasteners passing through the second perforation 11341 and the second through hole 11831. In such a way, the reliability and stability of the connection between the top connection frame 118 and the fourth vertical beam 113 can be ensured.

As shown in FIGS. 33 to 43, the frame structure also includes panels, namely a front panel 12, two side panels 13, a rear panel, and a top panel 14. The front panel 12 covers a front area of the support frame 11, and the front panel 12 has two openings 1201 spaced along an up-down direction. Positions of the two openings 1201 correspond to positions of clothes fetching ports 311 of the first clothes treatment module 20 and the second clothes treatment module 30. The rear panel covers a rear area of the support frame 11, and the two side panels 13 cover a left area and a right area of the support frame 11.

The connection mode of the front panel 12, the side panel 13 located on the left side, and the support frame 11 will be described in detail below. The third vertical beam 112 is arranged at a left front corner of the square base 111. A front side surface of the third vertical beam 112 has a frame connection hole 1104, a frame positioning hole 1106, and a frame perforation 1105. A left side of the front panel 12 has a panel mounting part 121 recessed relative to an outer surface of the front panel 12. The panel mounting part 121 is provided with a panel connection hole 1211 corresponding to the frame connection hole 1104, a panel positioning hole 1213 corresponding to the frame positioning hole 1106, and a panel perforation 1212 corresponding to the frame perforation 1105. A front side of the side panel 13 located on the left side has a panel covering part 131 bent toward the front panel 12, and the panel covering part 131 has a snap groove 1311 in an inner side of the panel covering part.

The panel mounting part 121 is connected to the third vertical beam 112 by a panel connector 122 passing through the panel connection hole 1211 and the frame connection hole 1104. The panel connector 122 includes a panel connection part 1221, a positioning post 1223, and a connection post 1222. The panel connection part 1221 is provided with a connection protrusion 1224 to define a recess 1225 recessed downward. The connection post 1222 includes two support legs 1221 spaced apart from each other.

During the assembly, the panel mounting part 121 of the front panel 12 can be first fixed to the third vertical beam 112 by screws; then the two support legs 1221 of the panel connector 122 can be pressed so that the connection post 1222 passes through the panel connection hole 1211 and the frame connection hole 1104 sequentially; afterwards, the two support legs 1221 can be loosened to achieve an anti-disengagement effect; the positioning post 1223 is arranged to pass through the frame positioning hole 1106 and the panel positioning hole 1213; the fasteners are arranged to pass through a connection perforation 12211, the panel perforation 1212, and the frame perforation 1105, and further ensuring the reliability of the connection among the panel connector 122, the panel mounting part 121, and the third vertical beam 112; finally, the side panel 13 is mounted in such a way that the panel covering part 131 of the side panel 13 covers the panel mounting part 121 of the front panel 12, and the side panel 13 is pushed downward or the gravity of the side panel 13 is utilized to make an upper edge of the snap groove 1311 in the panel covering part 131 snap into the recess 1225 of the panel connector 122, so that the panel covering part 131 of the side panel 13 covers the panel mounting part 121 of the front panel 12, screws on the panel mounting part 121, and the panel connector 122, without affecting the appearance of the frame structure.

Figure 9:
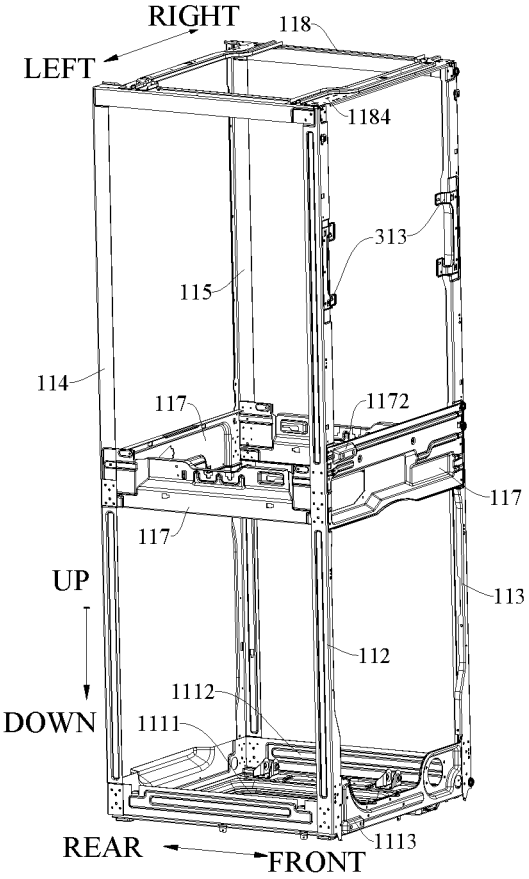
FIG. 9 is an assembly view of the support frame shown in FIG. 5.
Figure 34:
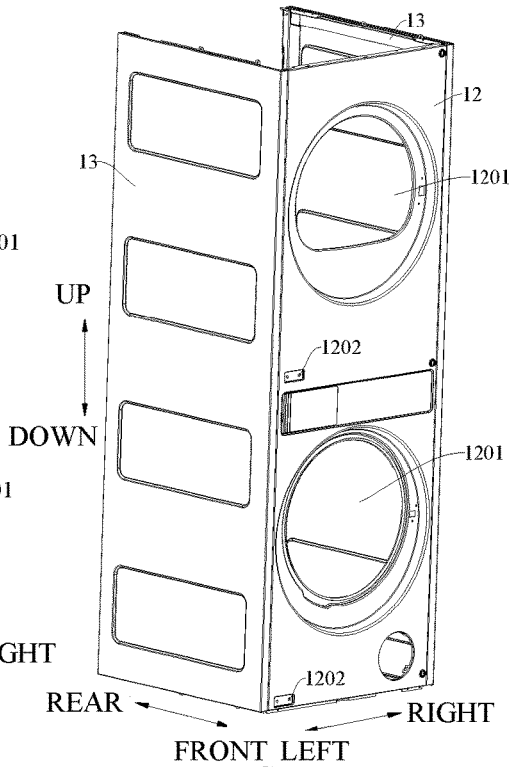
FIG. 34 is a part assembly view of a support frame of a clothes treatment apparatus according to an embodiment of the present disclosure.
Figure 35:
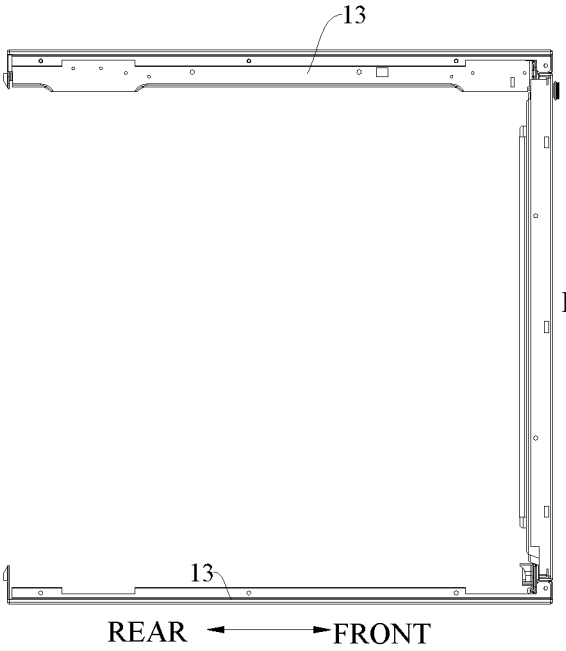
FIG. 35 is a top view of a structure shown in FIG. 34.
Figure 36:
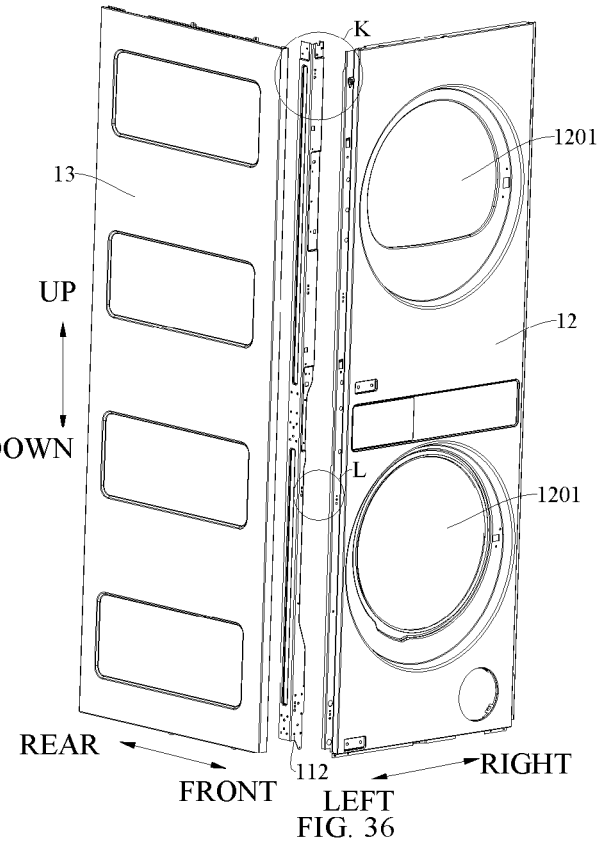
FIG. 36 is another part assembly view of a support frame of a clothes treatment apparatus according to an embodiment of the present disclosure.
Figure 37:
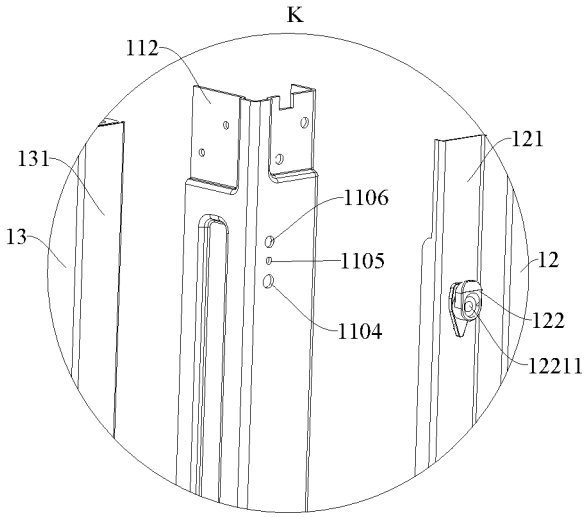
FIG. 37 is an enlarged view of part K shown in FIG. 36.
Figure 38:
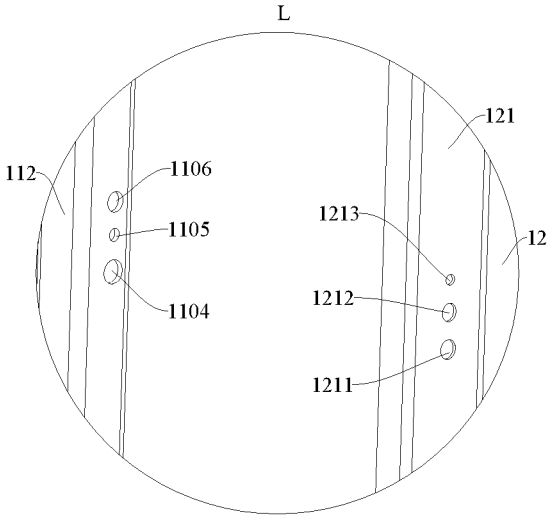
FIG. 38 is an enlarged view of part L shown in FIG. 36.
Figure 39:
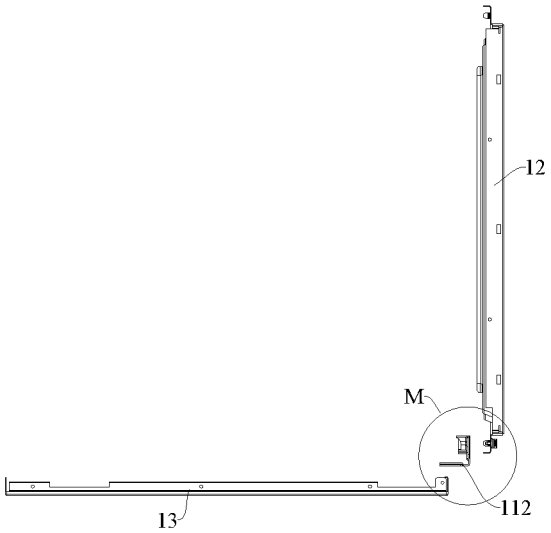
FIG. 39 is a top view of a structure shown in FIG. 36.
Figure 40:
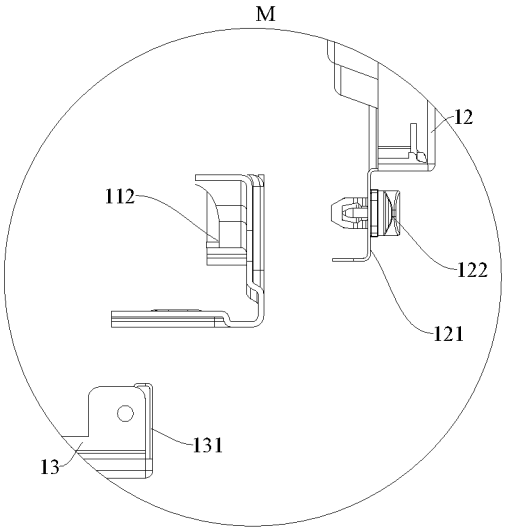
FIG. 40 is an enlarged view of part M shown in FIG. 39.
Figure 41:
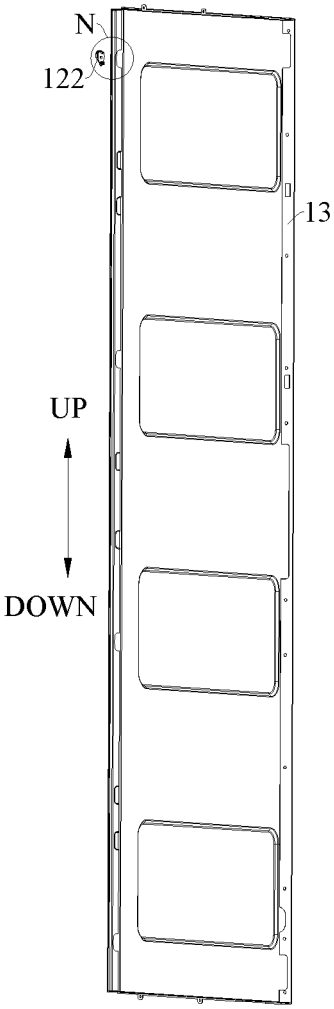
FIG. 41 is a structural schematic diagram of a side panel and a panel connector of a clothes treatment apparatus according to an embodiment of the present disclosure.
Figure 42:
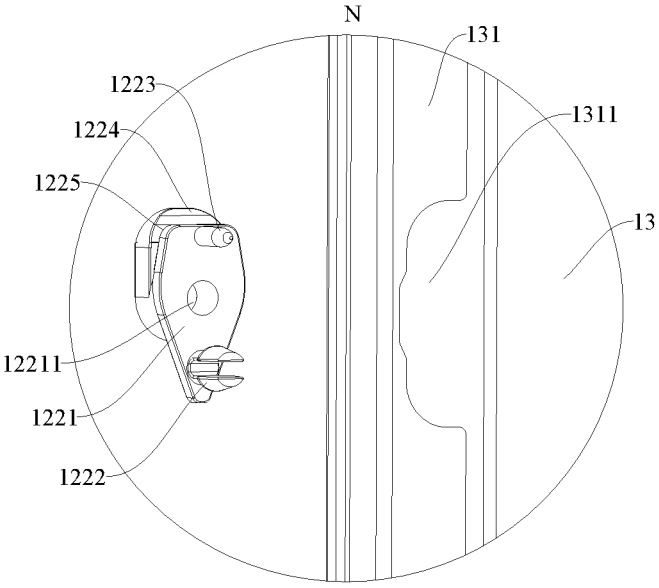
FIG. 42 is an enlarged view of part N shown in FIG. 41.
Figure 43:
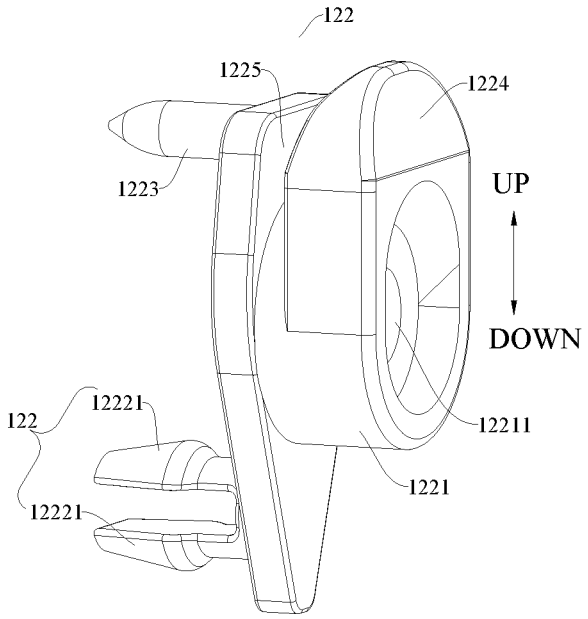
FIG. 43 is a structural schematic diagram of a panel connector of a clothes treatment apparatus according to an embodiment of the present disclosure.

As shown in FIGS. 9 and 34, a first hinge mount 1172 is arranged on a front surface of the connecting transverse beam 117 located between the third vertical beam 112 and the fourth vertical beam 113; a second hinge mount 1113 is arranged on a front surface of the side plate 1112 located between the third vertical beam 112 and the fourth vertical beam 113; and a second hinge mount 1184 is arranged on an upper surface of the top connection frame 118. A central portion of the front panel 12 has a mounting recess 1202, and a bottom wall of the mounting recess 1202 has a mounting hole 3325 corresponding to a perforation in the first hinge mount 1172. A lower portion of the front panel 12 also has one mounting recess 1202, and a bottom wall of the mounting recess 1202 has a mounting hole 3325 corresponding to a perforation in the second hinge mount 1184.

As shown in FIGS. 13 to 17, the door assembly 15 of the clothes treatment apparatus 100 includes a first door 151 and a second door 152, the first door 151 being located below the second door 152. An upper end of the first door 151 and a lower end of the second door 152 are each connected to the support frame 11 by an intermediate hinge 153. In one example, the intermediate hinge 153 includes an intermediate mounting part 1531 and an intermediate connection part 1532. The intermediate mounting part 1531 is arranged in the mounting recess 1202 and connected to the first hinge mount 1172 by fasteners to be fixed to a front portion of the mounting support frame 11. The intermediate connection part 1532 is connected to the intermediate mounting part 1531. An upper surface of the intermediate connection part 1532 has an upper fixed shaft 1533 extending upward, and the upper fixed shaft 1533 cooperates with the second door 152; and a lower surface of the intermediate connection part 1532 has a lower fixed shaft 1534 extending downward, and the lower fixed shaft 1534 cooperates with the first door 151.

A lower end of the first door 151 is connected to a lower end of the support frame 11 by a first end hinge 154. The first end hinge 154 includes a first end-face mounting part 1541 and a first end-face connection part 1542. The first end-face mounting part 1541 is arranged in the mounting recess 1202 and connected to the second hinge mount 1113 by fasteners to be fixed to a lower portion of the support frame 11. The first end-face connection part 1542 is connected to the first end-face mounting part 1541, and has a lower connection shaft 1543 extending upwards. The lower connection shaft 1543 cooperates with a lower end face of the first door 151.

An upper end of the second door 152 is connected to an upper end of the support frame 11 by a second end hinge 155. The second end hinge 155 includes a second end-face mounting part 1551 and a second end-face connection part 1552. The second end-face mounting part 1551 is connected to the second hinge mount 1184 on the upper surface of the top connection frame 118 by fasteners to be fixed to an upper portion of the support frame 11. The second end-face connection part 1552 is connected to the second end-face mounting part 1551, and has an upper connection shaft 1553 extending downward. The upper connection shaft 1553 cooperates with an upper end face of the second door 152.

Figure 13:
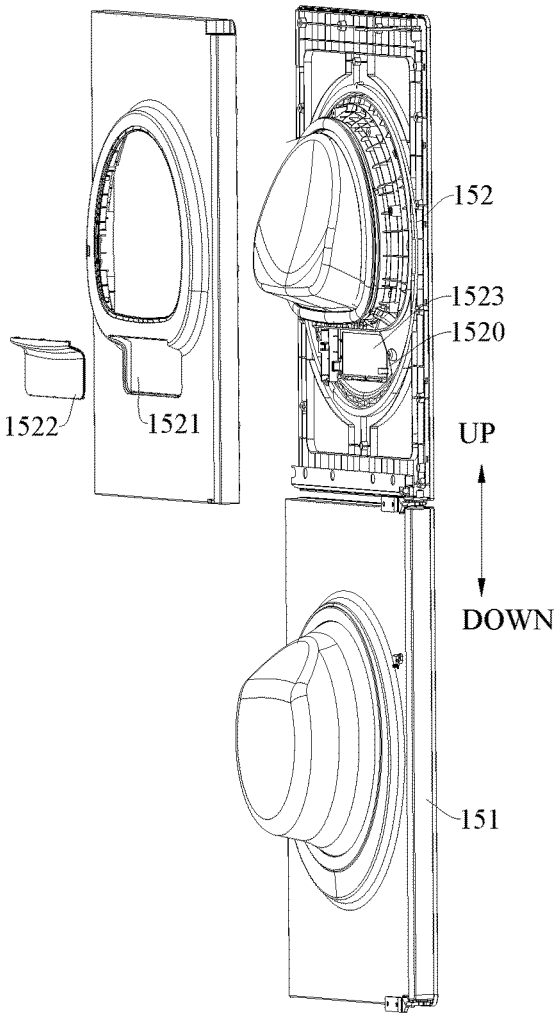
FIG. 13 is an exploded view of a door assembly of the clothes treatment apparatus shown in FIG. 3 according to an embodiment of the present disclosure.
Figure 14:
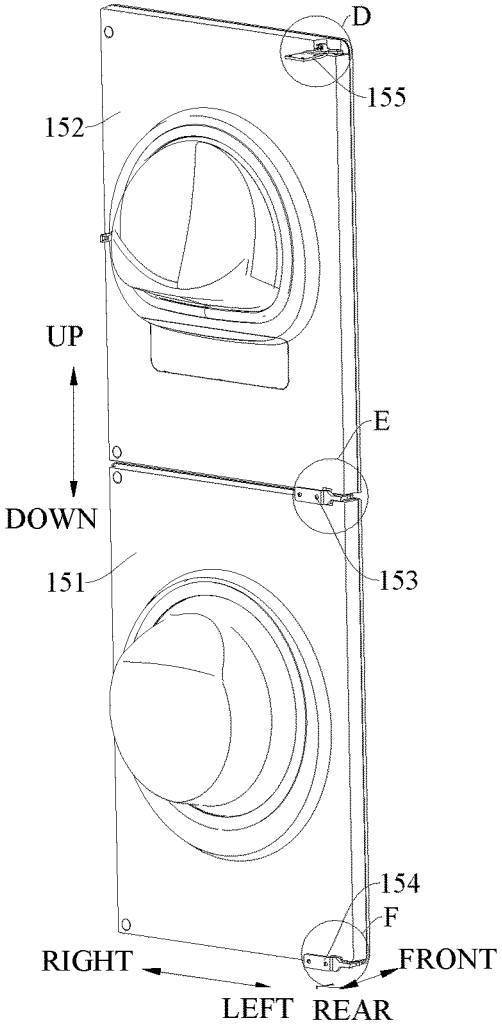
FIG. 14 is a structural schematic diagram of a door assembly of the clothes treatment apparatus shown in FIG. 3 according to an embodiment of the present disclosure.
Figure 15:
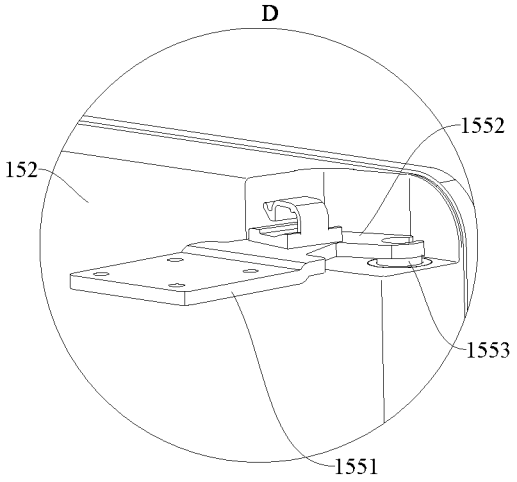
FIG. 15 is an enlarged view of part D shown in FIG. 14.
Figure 16:
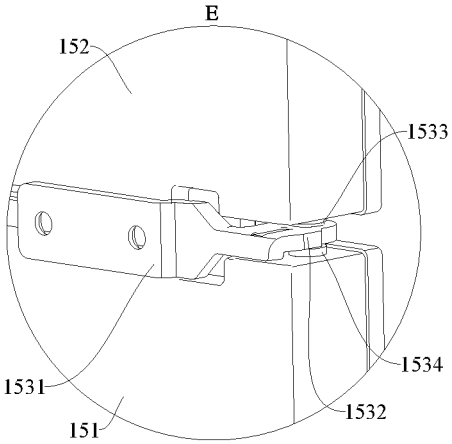
FIG. 16 is an enlarged view of part E shown in FIG. 14.
Figure 17:
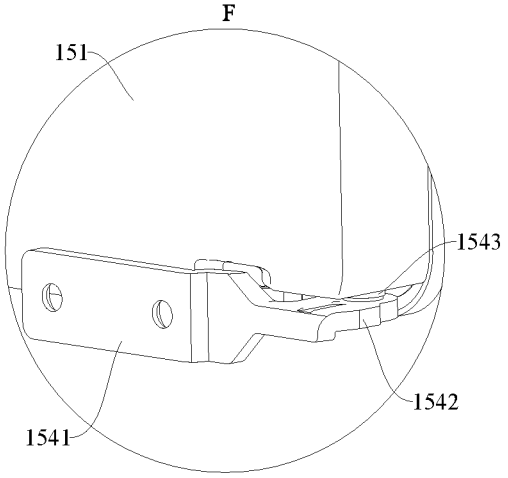
FIG. 17 is an enlarged view of part F shown in FIG. 14.
Figure 18:
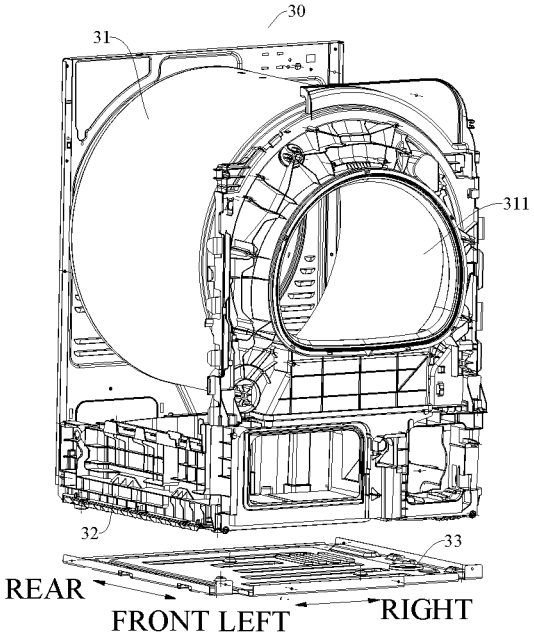
FIG. 18 is a structural schematic diagram of a clothes drying module of a clothes treatment apparatus according to an embodiment of the present disclosure from an angle of view.
Figure 19:
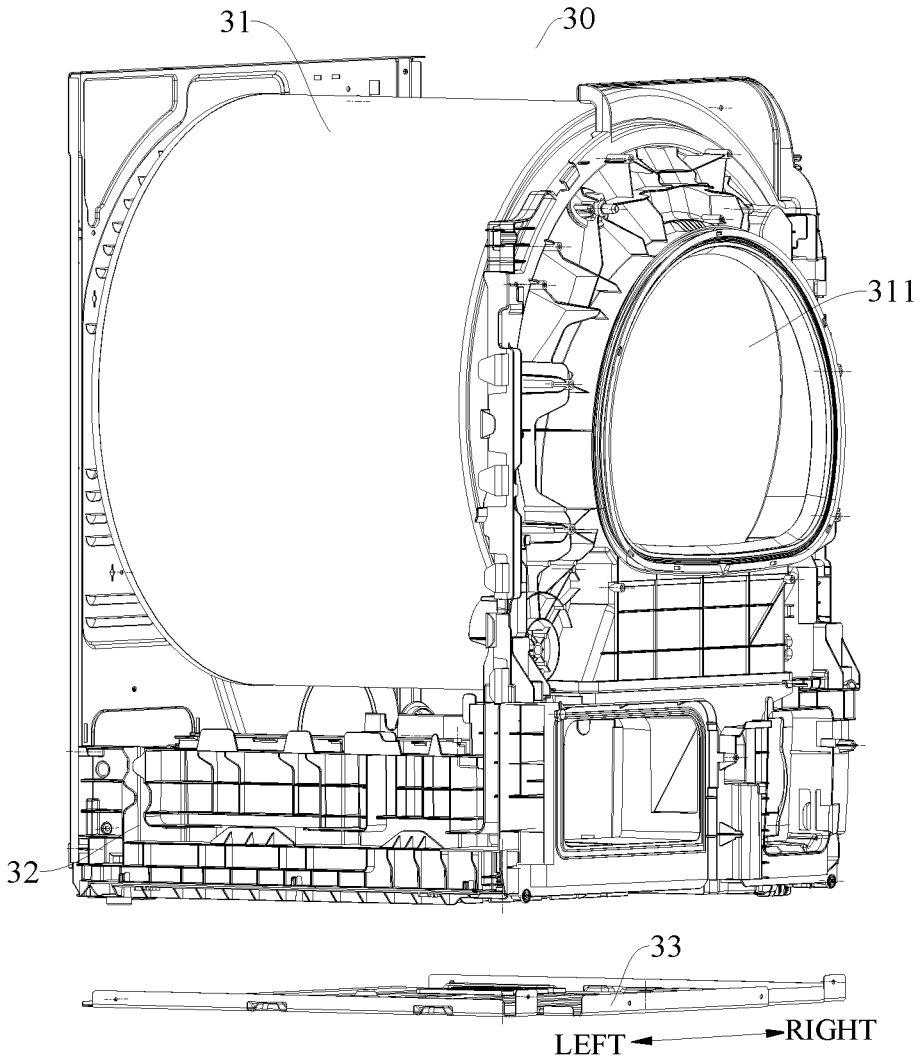
FIG. 19 is a structural schematic diagram of a clothes drying module of a clothes treatment apparatus according to an embodiment of the present disclosure from another angle of view.
Figure 20:
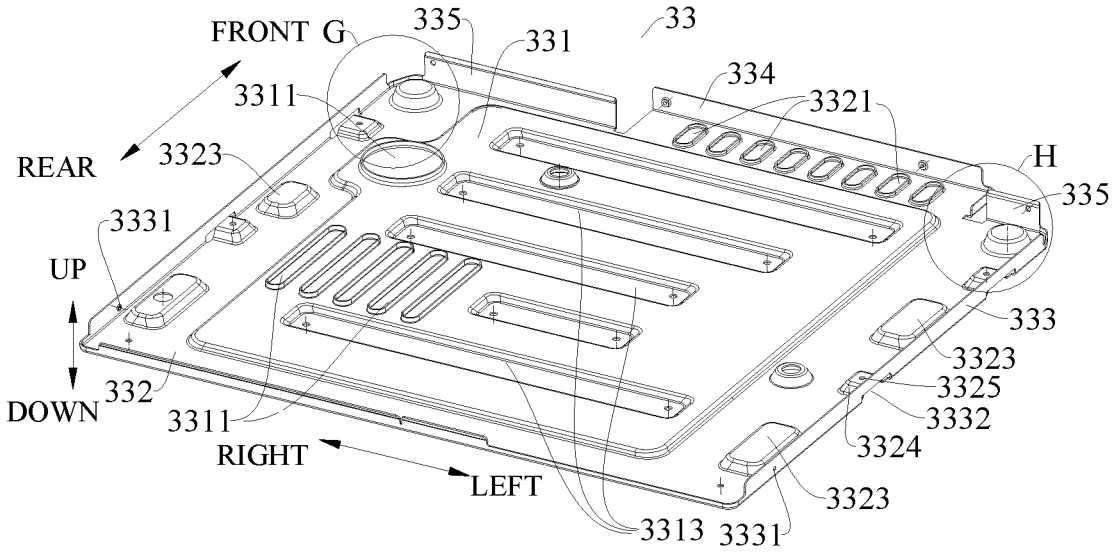
FIG. 20 is a structural schematic diagram of a reinforcement plate of a clothes treatment apparatus according to an embodiment of the present disclosure.
Figure 21:
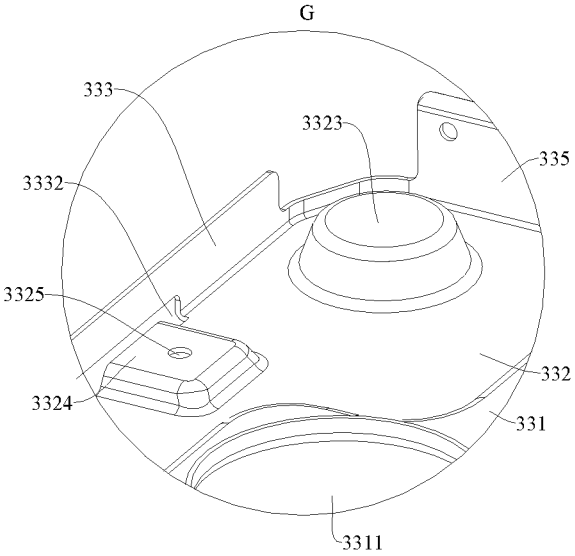
FIG. 21 is an enlarged view of part G shown in FIG. 20.
Figure 22:
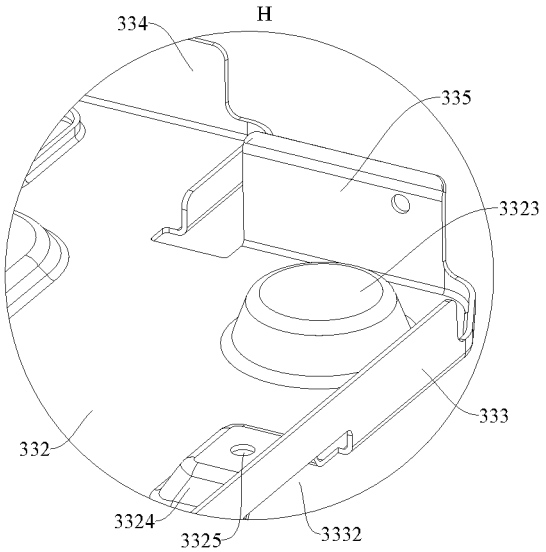
FIG. 22 is an enlarged view of part H shown in FIG. 20.
Figure 23:
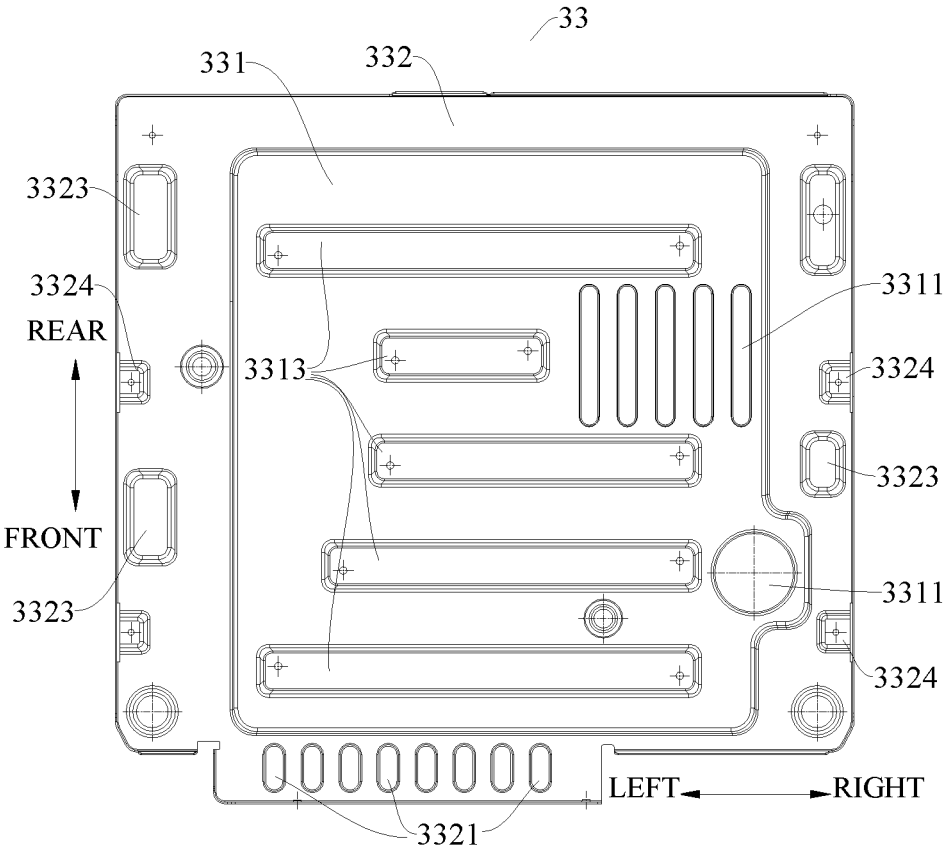
FIG. 23 is a top view of the reinforcement plate shown in FIG. 20.
Figure 24:
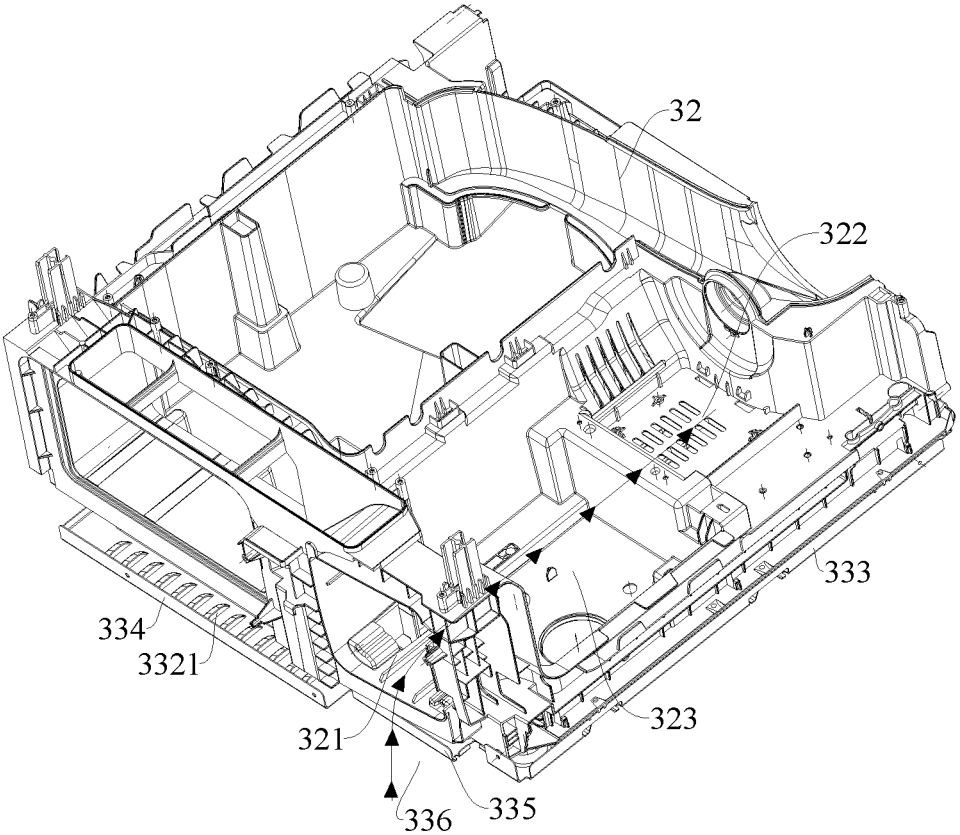
FIG. 24 is an assembly view of a reinforcement plate and a base of a clothes drying unit.
Figure 25:
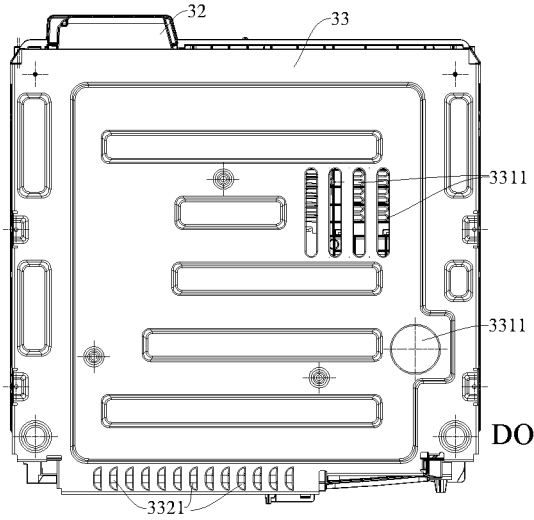
FIG. 25 is a bottom view of a structure shown in FIG. 24.
Figure 26:
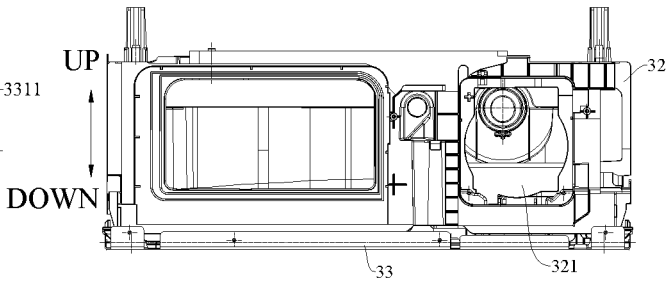
FIG. 26 is a side view of the structure shown in FIG. 24.

As shown in FIG. 13, an inward side of the second door 152 is provided with a mounting port 1521, and the control panel 1523 is mounted into a mounting cavity 1520 of the second door 152 via the mounting port 1521. A cover plate 1522 is adapted to removably close the mounting port 1521, and enclosing the control panel 1523 in the mounting cavity 1520 of the second door 152.

The first clothes treatment module 20 includes a first clothes treatment drum 21. The first clothes treatment module 20 may be a clothes washing module and is mounted in the first accommodation space 1101 located below. The second clothes treatment module 30 includes a second clothes treatment drum 31. The second clothes treatment module 30 may be a clothes drying module and is mounted in the second accommodation space 1102 located above. The clothes drying module is internally equipped with a control board that communicates with the control panel 1523. The clothes drying module works in a relatively low moisture environment, and will not cause damage to the control board.

As shown in FIGS. 18 to 26, the clothes drying module includes a clothes drying unit and a reinforcement plate 33 arranged below a chassis 32 of the clothes drying unit. The clothes drying module is connected to the support frame 11 through the reinforcement plate 33 pre-mounted on the clothes drying unit. There is a gap between the chassis 32 and the front panel 12.

The chassis 32 of the clothes drying unit includes a suction zone 321 for mounting a cooling fan, a fan mounting cavity 322, and a heat pump mounting cavity 323. The reinforcement plate 33 has first ventilation holes 3311 in communication with the fan mounting cavity 322, second ventilation holes 3321, and an avoidance notch 336 corresponding to the suction zone 321. An outer peripheral edge of the reinforcement plate 33 is provided with a first mounting flange 334 bent upward, for connection with the connecting transverse beam 117. The outer peripheral edge of the reinforcement plate 33 is also provided with a second mounting flange 335 bent upward and located inside the first mounting flange 334, for connection with the chassis 32 of the clothes drying unit.

The reinforcement plate 33 is substantially formed as a square plate and includes a first plate portion 331 and an extension portion recessed relative to the first plate portion 331. Second ventilation holes 3321 are provided in the extension portion. Reinforcement recesses 3313 are provided in the first plate portion 331 and spaced along the front-rear direction, and each reinforcement recess 3313 extends along the left-right direction. Reinforcement protrusions 3323 are arranged on a second plate portion 332 and spaced along a peripheral direction of the first plate portion 331. A fixing flange 333 bent upward is also arranged on an outer peripheral edge of the reinforcement plate 33, and is provided with a fixing hole 3331. The fixing flange 333 also has an insertion hole 3332 penetrating the fixing flange along its thickness direction. The reinforcement plate 33 is provided with a mounting boss 3324 adjacent to the insertion hole 3332, and the mounting boss 3324 is provided with a mounting hole 3325 in its top. For example, the support structure 312 has an insertion part that is suitable to be inserted from the insertion hole 3332 to be connected with the mounting boss 3324.

When the clothes drying module is operating, part of air located in the clothes washing module flows from the avoidance notch 336, through a gap between the suction zone 321 and the front panel 12, into the suction zone 321, to cool the heat pump system, and air between the clothes drying module and the clothes washing module may also circulate through the plurality of second ventilation holes 3321.

As shown in FIGS. 27 to 32, the clothes drying unit includes a drying drum and support structures 312 arranged at front and rear ends of the drying drum. The support structure 312 located at the front end of the drying drum is connected to the third vertical beam 112 and the fourth vertical beam 113 by two frame connectors 313.

The frame connector 313 includes a connection body 3134 and two connection arms 3135. The connection body 3134 extends along a length direction of the third vertical beam 112 or the fourth vertical beam 113. The two connection arms 3135 are attached to both ends of the connection body 3134 and extend toward the support structure 312, and the connection arms 3135 are recessed toward the second accommodation space 1102 relative to the connection body 3134. Each connection arm 3135 has a positioning recess 3137 recessed rearward in its front side, and has a pre-pressing boss 3136 protruding from its rear surface at a position corresponding to the positioning recess 3137. Each connection arm 3135 is provided with a first connection hole 3131 penetrating the pre-pressing boss 3136. The connection body 3134 is provided with a first fixing protrusion 3132 and a second fixing protrusion 3133 bent toward the third vertical beam 112 or the fourth vertical beam 113.

The support structure 312 has a second connection hole 3121 corresponding to the first connection hole 3131, and the frame connector 313 is connected to the support structure 312 by fasteners passing through the first connection hole 3131 and the second connection hole 3121. When the frame connector 313 is assembled with the support structure 312, the pre-pressing boss 3136 pushes the support structure 312 rearward and hence applies pre-pressure to the support structure 312, so that the support structure 312 has a backward pre-deformation, which can counteract a forward pushing force exerted by clothes in the clothes treatment drum on the support structure 312 when the clothes treatment apparatus 100 is working, and avoid problems such as air leakage or poor sealing due to the deformation of the support structure 312. The assembled frame connector 313 can also limit the position of the support structure 312 in the left-right direction to further improve the structural stability.

A front side surface of each of the third vertical beam 112 and the fourth vertical beam 113 is provided with a second accommodation recess 1132 recessed inward. A bottom wall of the second accommodation recess 1132 on the third vertical beam 112 is provided with a first fixing perforation 11321, and a bottom wall of the second accommodation recess 1132 on the fourth vertical beam 113 is provided with a first fixing perforation 11321. The frame connector 313 is arranged in the second accommodation recess 1132. The first fixing protrusion 3132 of the frame connector 313 arranged on the third vertical beam 112 is fitted into the first fixing perforation 11321, and the second fixing protrusion 3133 thereof is fitted into the second fixing perforation 11322, to realize the connection between the third vertical beam 112 and the frame connector 313. The first fixing protrusion 3132 of the frame connector 313 arranged on the fourth vertical beam 113 is fitted into the first fixing perforation 3132, and the second fixing protrusion 3133 thereof is fitted into the second fixing perforation 11322, to realize the connection between the fourth vertical beam 113 and the frame connector 313.

The positioning bracket 314 is arranged on the top of the support frame 11. The positioning bracket 314 includes: a first connection plate 3141 and a second connection plate 3142. The first connection plate 3141 extends along the horizontal direction and is fixedly connected to the support frame 11. The second connection plate 3142 extends in the vertical direction, an upper side of the second connection plate 3142 is connected to the first connection plate 3141, and a lower side of the second connection plate 3142 is formed into an insertion part 3143. The first connection plate 3141 is also provided with a positioning protrusion 3144 and a positioning flange 3145 both extending downward.

The support frame 11 includes a top connection frame 118 on the top. The top connection frame 118 includes a top transverse beam 1181. A positioning groove 11811 and a fixing boss 11812 are arranged on a top surface of the top transverse beam 1181. The fixing boss 11812 is located on a side of the positioning groove 11811. The positioning groove 11811 and the fixing boss 11812 each extend along a length direction of the top transverse beam 1181. The fixing boss 11812 is provided with a bracket positioning hole 11813. The bracket positioning hole 11813 includes a first hole site 118131 and a second hole site 118132 in communication with each other, and a size of the first hole site 118131 is larger than a size of the second hole site 118132.

When the positioning bracket 314 is mounted, the positioning flange 3145 is first inserted into the positioning groove 11811, and the positioning flange 3145 can stop against a side wall of a side of the positioning groove 11811 close to the fixing boss 11812; then, the positioning protrusion 3144 is inserted into the first hole site 118131 and slides towards the second hole site 118132; after the positioning protrusion 3144 and the bracket positioning hole 11813 are fitted in place, the positioning bracket 314 is fixedly connected to the top transverse beam 1181 by fasteners, thus making the connection between the positioning bracket 314 and the top transverse beam 1181 stable.

The support structure 312 is provided with a first positioning plate 31221 and a second positioning plate 31222 protruding from the outer surface of the support structure 312. There are two first positioning plates 31221, and the first positioning plate 31221 form arc-shaped plates. An insertion groove 3122 with a leftward opening and an insertion groove 3122 with a rightward opening are defined between the first positioning plate 31221 and the support structure 312. The second positioning plate 31222 closes lower openings of the insertion grooves 3122. Reinforcement ribs 31223 are arranged on an outer surface of the first positioning plate 31221 and spaced along the vertical direction, to improve the structural strength of the first positioning plates 31221.

When the positioning bracket 314 cooperates with the support structure 312, the insertion part 3143 on the lower side of the second connection plate 3142 can be inserted into the insertion groove 3122, and a bottom of the insertion groove 3122 stops against a lower edge of the second connection plate 3142, and the insertion groove 3122 can support the second connection plate 3142 to a certain extent and improve the structural stability. Meanwhile, the displacement of the support structure 312 in the front-rear direction and the left-right direction can restricted under the action of the second connection plate 3142, and preventing the support structure 312 from being deformed by force during the operation of the clothes treatment apparatus 100, avoiding problems such as air leakage or poor sealing due to the deformation of the support structure 312, improving the overall structural strength and extending the service life.

In the description of the present disclosure, it shall be understood that terms such as "central," "longitudinal," "transverse," "length," "width," "thickness," "up," "down," "front," "rear," "left," "right," "vertical," "horizontal," "top," "bottom," "inner," "outer," "axial," "radial," "circumferential" and the like should be construed to refer to the orientation as then described or as shown in the drawings under discussion. These relative terms are for convenience and simplicity of description and do not indicate or imply that the devices or elements referred to have a particular orientation and be constructed or operated in a particular orientation. Thus, these terms shall not be construed as limitation on the present disclosure.

Other configurations (such as a clothes drying module, a clothes washing module and etc.) and operations of the clothes treatment apparatus 100 according to the embodiments of the present disclosure.

In the description of the present disclosure, reference to terms "one embodiment," "some embodiments," "an exemplary embodiment," "an example," "a specific example," "some examples" or the like means that a particular feature, structure, material, or characteristic described in connection with the embodiment or example is included in at least one embodiment or example of the present disclosure. In this specification, the above terms are not necessarily referring to the same embodiment or example. Furthermore, the particular features, structures, materials, or characteristics described may be combined in any suitable manner in one or more embodiments or examples.

What is claimed is:

1. A frame assembly of a clothes treatment apparatus, comprising:

a support frame forming an accommodation space for accommodating a clothes treatment drum, the support frame including a square base, a plurality of transverse beams, and a plurality of vertical beams;

a support structure connected to the support frame and supporting the clothes treatment drum; and a limiting structure arranged on the support frame and cooperating with the support structure to limit displacement of the support structure, the limiting structure including a positioning bracket connected to a top transverse beam of the plurality of transverse beams of the support frame.

2. The frame assembly according to claim 1, wherein an insertion groove is formed on one of the positioning bracket and the support structure, and an insertion part is formed on another of the positioning bracket and the support structure, the insertion part being inserted into the insertion groove.

3. The frame assembly according to claim 2, wherein the support structure is provided with a first positioning plate protruding from an outer surface of the support structure, and the first positioning plate and the support structure define the insertion groove.

4. The frame assembly according to claim 3, wherein the support frame is provided with a second positioning plate protruding from the outer surface of the support structure, and the second positioning plate and the first positioning plate are connected to close a lower opening of the insertion groove.

5. The frame assembly according to claim 3, wherein a reinforcement rib is arranged on an outer surface of the first positioning plate.

6. The frame assembly according to claim 3, wherein at least two first positioning plates and the support structure define at least two insertion grooves, and openings of the at least two insertion grooves are arranged opposite to each other.

7. The frame assembly according to claim 2, wherein the positioning bracket comprises:

a first connection plate fixedly connected to the support frame; and a second connection plate connected to the first connection plate, at least a portion of the second connection plate being formed into the insertion part.

8. The frame assembly according to claim 1, wherein:

the top transverse beam has a bracket positioning hole, and the positioning bracket has a positioning protrusion protruding downward;

the bracket positioning hole comprises a first hole site and a second hole site in communication with each other, and a size of the first hole site is larger than a size of the second hole site; and the positioning protrusion is configured to be inserted downwards into the first hole site and slide towards the second hole site.

9. The frame assembly according to claim 8, wherein:

the top transverse beam has a positioning groove and a fixing boss arranged on a top surface of the top transverse beam, and the fixing boss is located on a side of the positioning groove;

the positioning groove and the fixing boss each extend along a length direction of the top transverse beam, the bracket positioning hole is arranged on the fixing boss, and the positioning bracket has a positioning flange configured to be inserted into the positioning groove.

10. The frame assembly according to claim 1, wherein the positioning bracket is fixedly connected to the top transverse beam by a fastener.

11. The frame assembly according to claim 1, wherein:

the limiting structure further comprises a frame connector arranged in a middle of the support frame and connected to the support structure; and the frame connector has a pre-pressing boss protruding towards a side of the support structure, and the pre-pressing boss is configured to exert pre-pressure on the support structure.

12. The frame assembly according to claim 11, wherein:

the frame connector is provided with a first connection hole, and the support structure is provided with a second connection hole; and the frame connector and the support structure are connected by a fastener passing through the first connection hole and the second connection hole, and the first connection hole runs through the pre-pressing boss.

13. The frame assembly according to claim 11, wherein the frame connector comprises:

a connection body fixedly connected to the support frame; and a connection arm arranged on a side of the connection body facing the support structure, wherein a first side of the connection arm facing away the support structure has a positioning recess, a second side of the connection arm facing the support structure has the pre-pressing boss, and a position of the pre-pressing boss corresponds to a position of the positioning recess.

14. The frame assembly according to claim 13, wherein the connection body extends along a vertical direction, two connection arms are arranged at two ends of the connection body, and the connection arms are recessed toward an interior of the support frame relative to the connection body.

15. The frame assembly according to claim 11, wherein the frame connector is one of two frame connectors, and the two frame connectors are arranged on left and right sides of the support structure, respectively.

16. A clothes treatment apparatus, comprising:

a frame assembly of a clothes treatment apparatus, comprising:

a support frame forming an accommodation space for accommodating a clothes treatment drum, the support frame including a square base, a plurality of transverse beams, and a plurality of vertical beams;

a support structure connected to the support frame and supporting the clothes treatment drum; and a limiting structure arranged on the support frame and cooperating with the support structure to limit displacement of the support structure, the limiting structure including a positioning bracket connected to a top transverse beam of the plurality of transverse beams of the support frame.

17. A frame assembly of a clothes treatment apparatus, comprising:

a support frame forming an accommodation space for accommodating a clothes treatment drum, the support frame including a square base, a plurality of transverse beams, and a plurality of vertical beams;

a support structure connected to the support frame and supporting the clothes treatment drum; and a limiting structure arranged on the support frame and cooperating with the support structure to limit displacement of the support structure, the limiting structure including two frame connectors arranged at two of the plurality of vertical beams, respectively, and connected to the support structure.

* * * * *